US009156253B2

(12) United States Patent
Takata

(10) Patent No.: US 9,156,253 B2
(45) Date of Patent: Oct. 13, 2015

(54) INKJET PRINTER, LIQUID EJECTION DEVICE, AND PRINTING METHOD

(71) Applicant: Masayuki Takata, Nagoya (JP)

(72) Inventor: Masayuki Takata, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/208,495

(22) Filed: Mar. 13, 2014

(65) Prior Publication Data

US 2014/0292867 A1 Oct. 2, 2014

(30) Foreign Application Priority Data

Mar. 28, 2013 (JP) ..... 2013-070045

(51) Int. Cl.
*B41J 2/045* (2006.01)

(52) U.S. Cl.
CPC ..... *B41J 2/04563* (2013.01); *B41J 2/0458* (2013.01); *B41J 2/04573* (2013.01); *B41J 2/0454* (2013.01)

(58) Field of Classification Search
CPC .. B41J 2/04563; B41J 2/04573; B41J 2/0458; B41J 29/393; B41J 2/04581; B41J 2/04591
See application file for complete search history.

(56) References Cited

U.S. PATENT DOCUMENTS

| | | | | |
|---|---|---|---|---|
| 5,995,067 | A | 11/1999 | Terasawa et al. | |
| 6,315,379 | B1 * | 11/2001 | Adams et al. | 347/14 |
| 6,951,378 | B1 * | 10/2005 | Yamada et al. | 347/18 |
| 7,029,095 | B2 * | 4/2006 | Tsuboi et al. | 347/35 |
| 2012/0249642 | A1 * | 10/2012 | Takata et al. | 347/14 |
| 2013/0100196 | A1 * | 4/2013 | Donahue et al. | 347/17 |

FOREIGN PATENT DOCUMENTS

| | | | |
|---|---|---|---|
| JP | 6-246931 | A | 9/1994 |
| JP | 6-270418 | A | 9/1994 |
| JP | 2700578 | B2 | 1/1998 |
| JP | 10-86409 | A | 4/1998 |
| JP | 11-28826 | A | 2/1999 |
| JP | 2001-293852 | A | 10/2001 |
| JP | 2002-211011 | A | 7/2002 |
| JP | 2005-225214 | A | 8/2005 |
| JP | 2005-297489 | A | 10/2005 |
| JP | 2011-62829 | A | 3/2011 |

OTHER PUBLICATIONS

Notice of Reasons for Rejection issued in related JP application No. 2013-070045, mailed Jul. 14, 2015.

* cited by examiner

*Primary Examiner* — Manish S Shah
*Assistant Examiner* — Jeremy Delozier
(74) *Attorney, Agent, or Firm* — Merchant & Gould PC

(57) ABSTRACT

An inkjet printer configured to print by ejecting ink based on print data, an inkjet head comprising a plurality of nozzles, the plurality of nozzles divided into a plurality of nozzle groups, each nozzle of a nozzle group configured to eject ink of a same color and type and a control device configured to control the inkjet head to print in a normal print mode and a low-temperature print mode.

22 Claims, 22 Drawing Sheets

INKJET PRINTER, LIQUID EJECTION DEVICE, AND PRINTING METHOD

CROSS-REFERENCE TO RELATED APPLICATION

This application claims priority from Japanese Patent Application No. 2013-070045, filed on Mar. 28, 2013, which is incorporated herein by reference in its entirety.

TECHNICAL FIELD

Aspects described herein relate to a printing technique using an inkjet printer or a liquid ejection device.

BACKGROUND

An example of a liquid ejection device prints characters and/or images by ejecting liquid through one or more nozzles onto a recording medium. When ink temperature is low (e.g., a threshold dictated by the type of ink), ink may become highly viscous, thereby making it difficult to eject ink from the nozzles and resulting in an occurrence of ejection failure. Often, inkjet printers that have facsimile functionality receive facsimile data when atmospheric temperature is low, e.g., in the early morning, and perform printing upon receipt of the facsimile data under conditions where the ink temperature is still low. These low-temperature printing conditions can cause a failure in the printing of all ink dots in a printed result, thereby causing, for example, characters to become blurred printed information to become illegible.

In order to solve such printing problems, some known inkjet printers prohibit the reception of facsimile data and the recording operation performed by an inkjet head when it is determined that an ink temperature sensed by a temperature sensor is lower than or equal to a predetermined temperature (e.g., ambient and/or ink temperature). Thereafter, when the ink temperature rises above the predetermined ink temperature, the inkjet printer permits reception of the facsimile data and removes the prohibition of the recording operation performed by the inkjet head.

In yet another known inkjet printer, both the reception of facsimile data and the printing of facsimile data onto a recording medium may be prohibited when the ink temperature is low. Nevertheless, such a configuration may prevent printing from starting until the ink temperature rises to a predetermined temperature even when information received via facsimile communication is desired to be confirmed at once, for example, in the early morning. Thus, it may be impossible to confirm the information until printing is performed after the ink temperature rises at or above the predetermined temperature. The same problem may also occur in a printer that might not have a facsimile function. That is, even when it is desired to perform printing immediately from a personal computer ("PC"), printing may be prevented from starting until an ink temperature in the printer rises to a certain temperature.

SUMMARY

Some embodiments of the present disclosure provide for an inkjet printer, a liquid ejection device, and a printing method that allows for printing during low-temperature conditions and seeks to prevent or reduce the likelihood that a printed character and/or a printed image is illegible due to missing dots of the printed character and/or printed image.

According to example aspects of the present disclosure, an inkjet printer configured to perform printing on a medium by ejecting ink based on print data is disclosed. The example embodiments discussed herein and can be implemented as described below.

According to one or more aspects of the disclosure, an inkjet printer configured to perform printing comprises an inkjet head comprising a plurality of nozzles, the plurality of nozzles are divided into a plurality of nozzle groups, each nozzle of a nozzle group configured to eject ink of a same color and type. The inkjet head further comprises a temperature sensor configured to sense a temperature; and a control device configured to: acquire a temperature value based on the temperature sensed by the temperature sensor; and control the inkjet head to print in a normal print mode, wherein the inkjet head ejects ink toward a dot formation area based on the print data from one nozzle from each of one or more selected nozzle groups to form a dot on the dot formation area. In this embodiment, the one or more selected nozzle groups being from among the one or more nozzle groups and the normal print mode used under a condition in which the temperature value is greater than or equal to a predetermined value. Finally, the control device is further configured to control the inkjet head to print in a low-temperature print mode, wherein the inkjet head ejects ink toward the dot formation area from at least two nozzles in the each of the selected nozzle groups to form at least one dot on the dot formation area, the low-temperature print mode used under a condition in which the temperature value is smaller than the predetermined value.

According to one or more further aspects of the disclosure, a method for printing on a medium based on print data using an inkjet printer is disclosed. The disclosed method comprises ejecting ink from one nozzle in each of one or more selected nozzle groups from among a plurality of nozzle groups toward a dot formation area on a medium, under a normal condition in which the temperature is greater than or equal to a predetermined value. The method further includes ejecting ink toward the dot formation area from at least two nozzles in each of the selected nozzle groups to form at least one dot on the dot formation area on a medium under a low temperature condition in which the temperature is smaller than the predetermined value; wherein each nozzle group of the plurality of nozzle groups including nozzles configured to eject ink of a same color and type.

According to one or more additional aspects of the disclosure, a method for printing on a medium based on print data using an inkjet printer is disclosed. The disclosed method comprising: selecting a print mode from among a normal print mode and a low-temperature print mode; wherein in the normal print mode, the inkjet printer ejects ink from a plurality of nozzles, wherein the plurality of nozzles are divided into a plurality of nozzle groups, toward a dot formation area on the medium from one nozzle each of one or more selected nozzle groups being from among the one or more nozzle groups, under a normal condition in which the temperature is greater than or equal to a predetermined value. The method further comprises wherein in the low-temperature print mode, the inkjet printer ejects ink toward the dot formation area from at least two nozzles in each of the selected nozzle groups to form at least one dot on the dot formation area under a low temperature condition in which the temperature is smaller than the predetermined value.

According to the aspects of the present disclosure, under low-temperature conditions, at least one of a plurality of types of ink may be ejected from two or more nozzles to form multiple, contiguous dots (to appear as a single, unified dot) on the one dot formation area of the recording medium. Therefore, if one of the nozzles that is intended to eject ink on the one dot formation area experiences ejection failure due to low temperature conditions, at least one dot is still formed on the one dot formation area from the supplemental nozzles that additionally eject ink on the one dot formation area. Thus, the failure of a nozzle to eject ink caused by low temperature conditions is less likely to result in an entire dot failing to print on a one dot formation area for the reason that a plurality of dots are formed on the one dot formation area using a plurality of nozzles. Accordingly, a printed character and/or a printed image may be prevented from becoming blurred or otherwise illegible.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
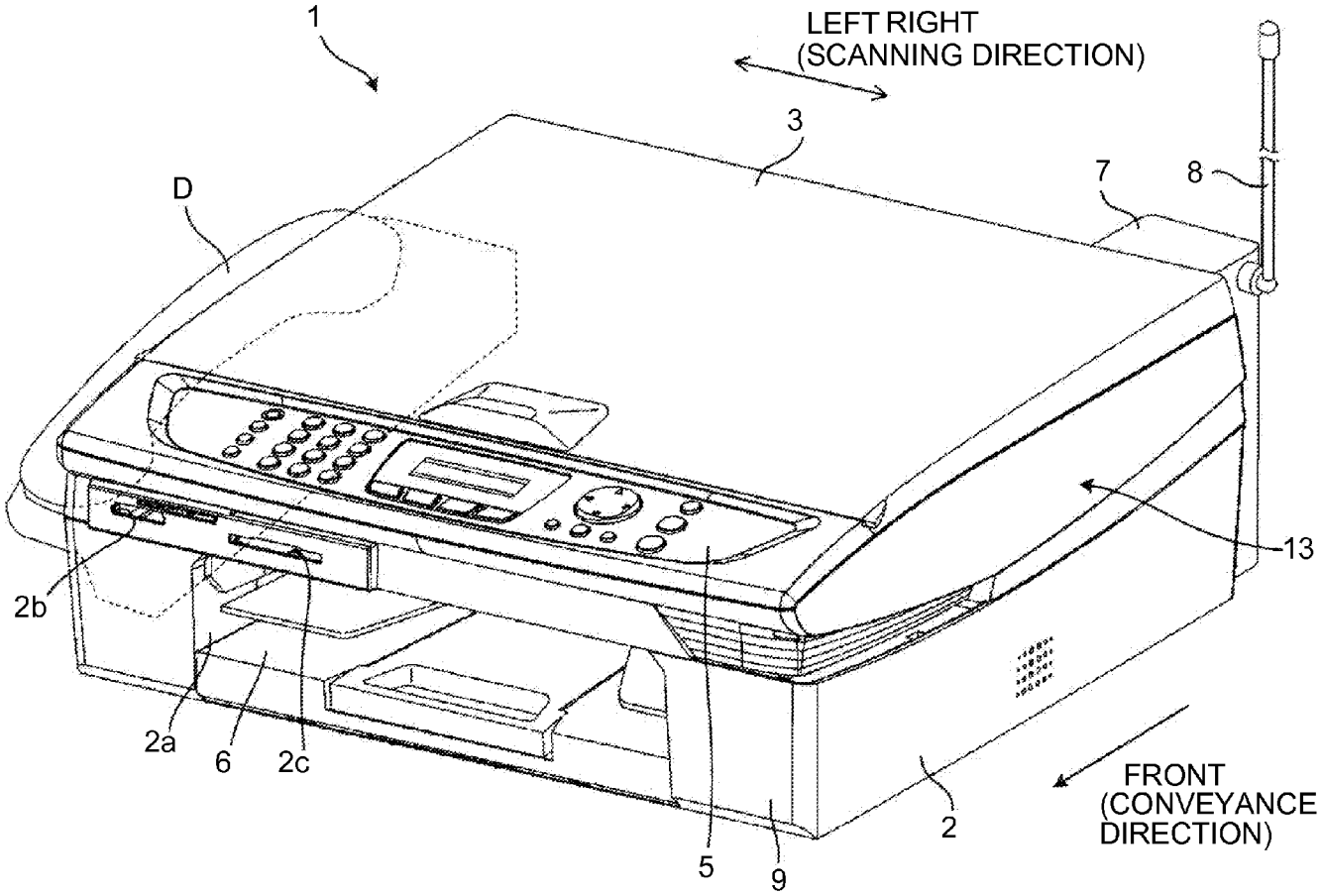
FIG. 1 is a perspective view depicting an inkjet printer in an illustrative embodiment according to one or more aspects of the disclosure.

Various embodiments will be described in detail with reference to the drawings, wherein like reference numerals represent like parts and assemblies throughout the several views. Reference to various embodiments does not limit the scope of the claims attached hereto. Additionally, any example set forth in the specification are not intended to be limiting and merely set forth some of the many possible embodiments for the appended claims.

Within this patent document, the conjunction "or" connotes "and/or" inappropriate. The indefinite articles "a" and "an" connotes "one or more" unless stated otherwise or where the use of "one or more" is clearly inappropriate. Additionally, qualifiers such as "about" and "substantially" connotes physical structures, physical relationships, and values for given measurements, parameters, ranges, and the like, can vary due to differences in manufacturing tolerances and conditions of use.

Figure 2:
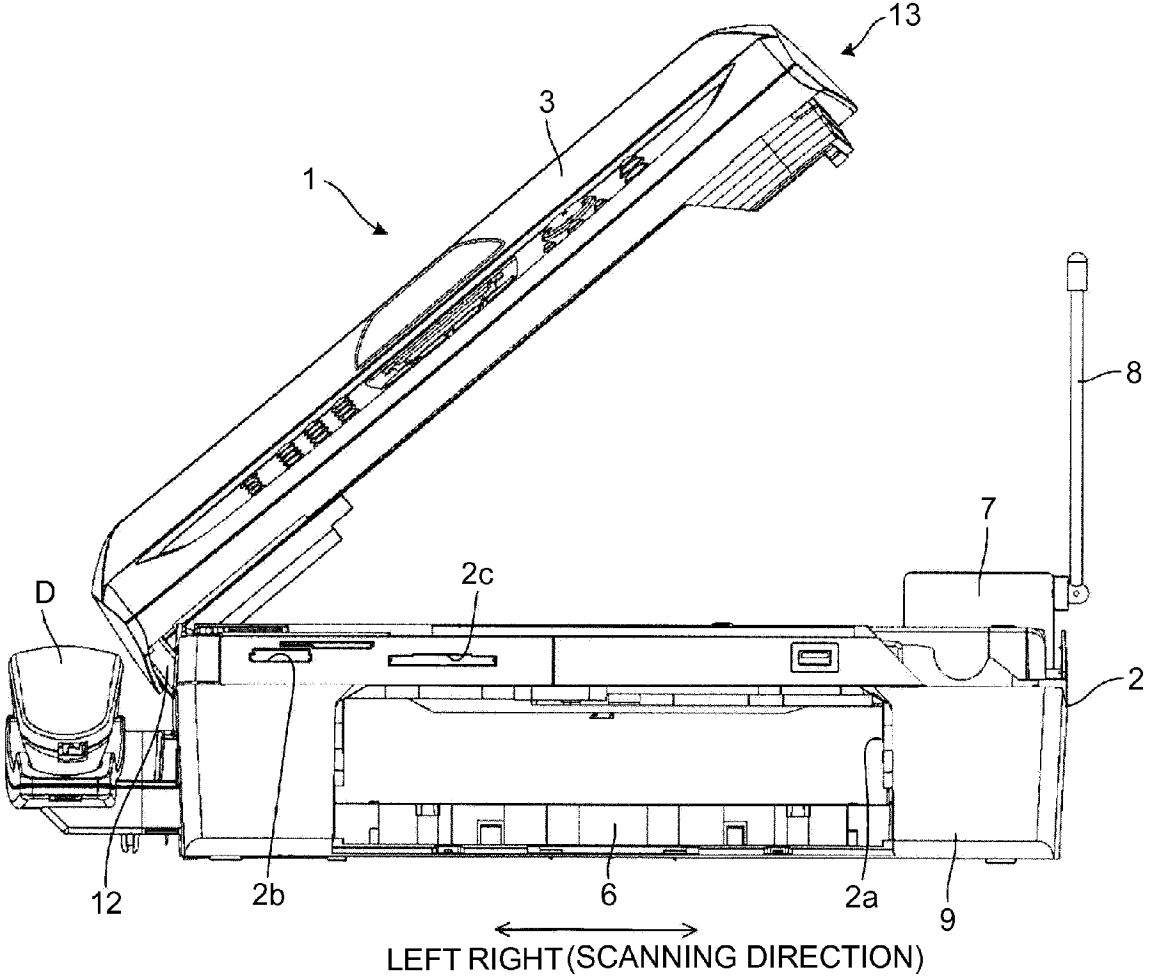
FIG. 2 is a front view depicting the inkjet printer in the illustrative embodiment according to one or more aspects of the disclosure.
Figure 3:
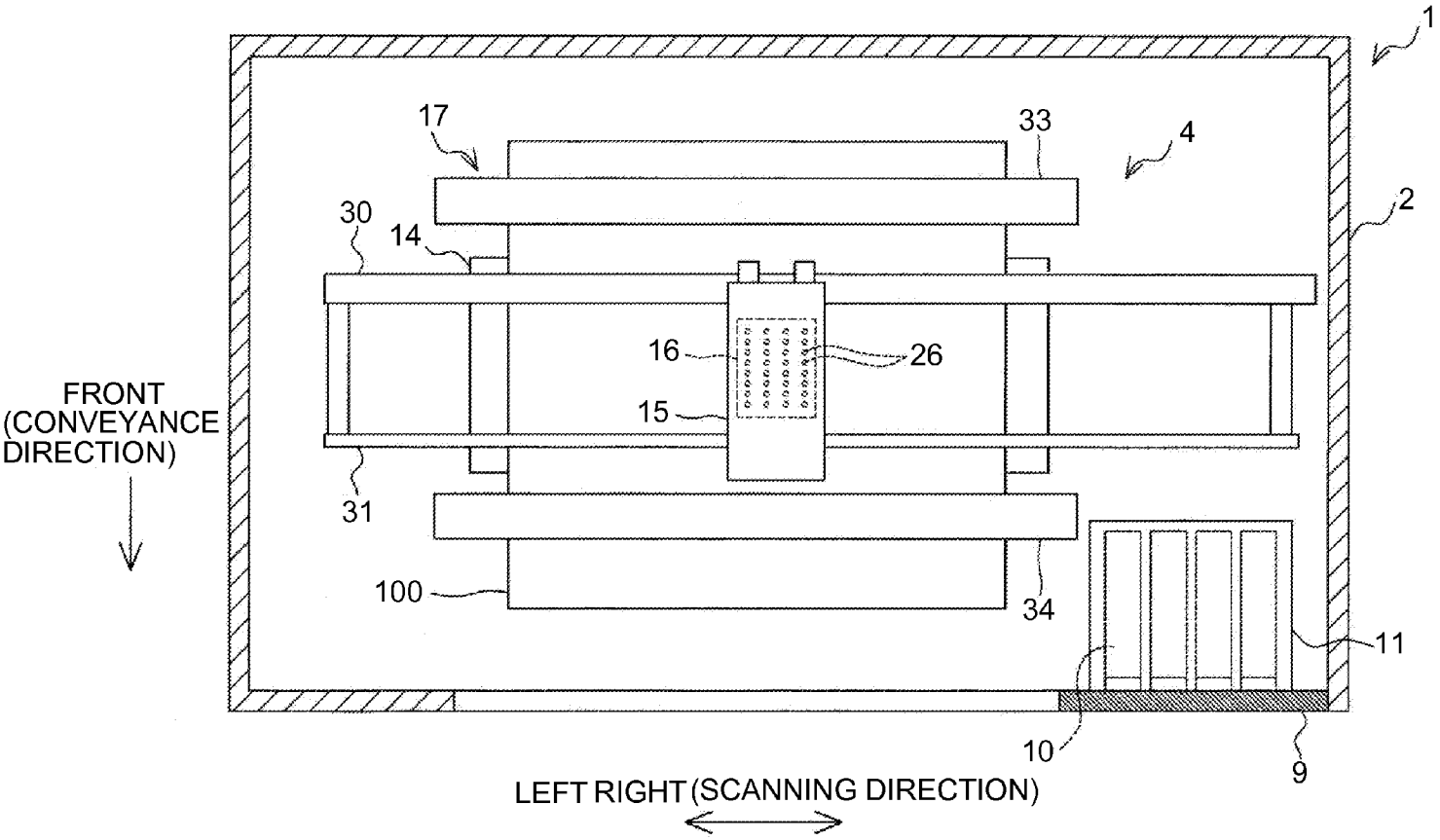
FIG. 3 is a schematic plan view depicting an internal configuration of the inkjet printer in the illustrative embodiment according to one or more aspects of the disclosure.
Figure 4:
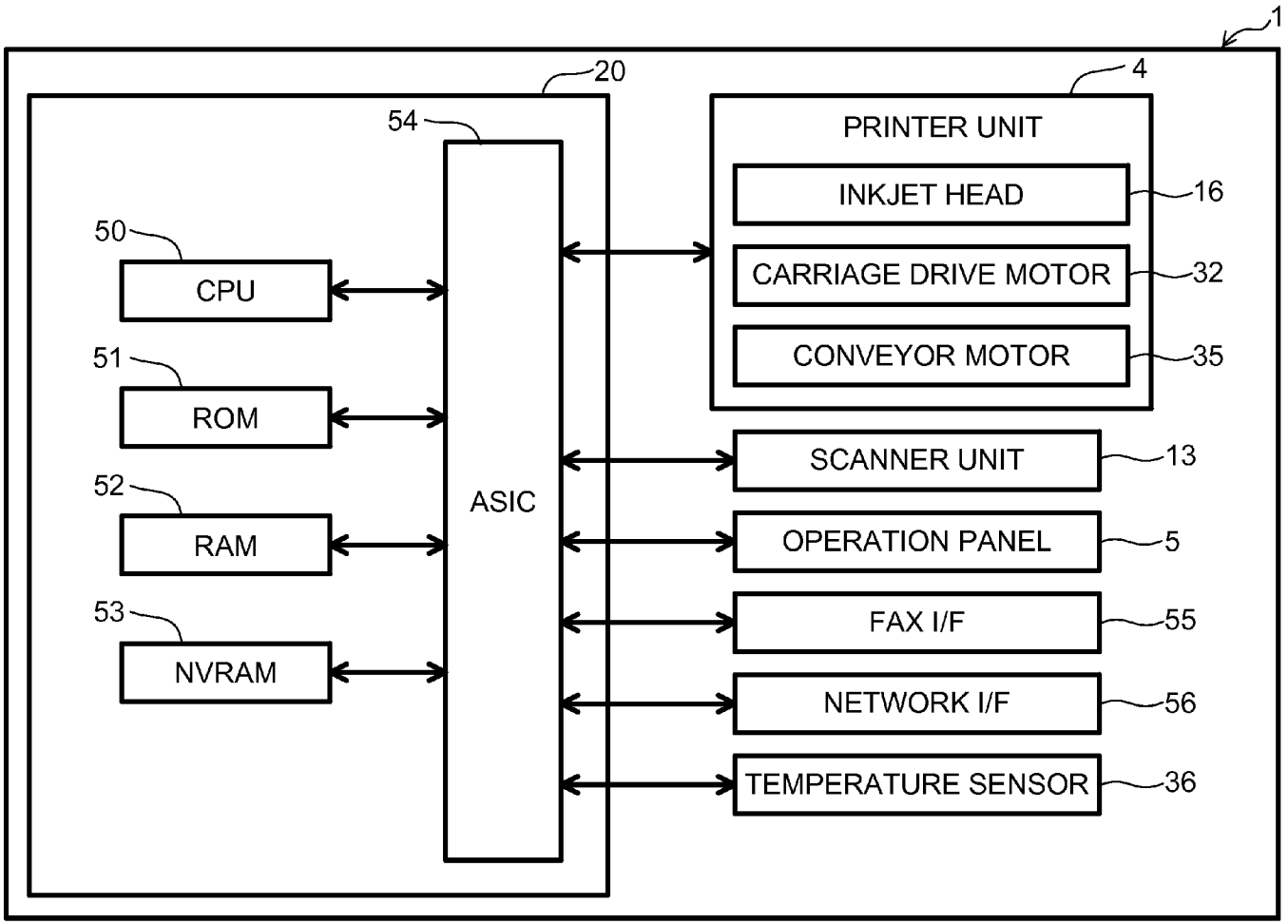
FIG. 4 is a block diagram depicting an electrical configuration of the inkjet printer in the illustrative embodiment according to one or more aspects of the disclosure.

1 is a perspective view of an inkjet printer 1 according to an illustrative embodiment. FIG. 2 is a front view of the inkjet printer 1. With reference to the inkjet printer 1 (hereinafter, simply referred to as "printer 1"), directions of up, down, right, left, front, and rear may be defined with reference to an orientation of the printer 1 that may be disposed in which it may be intended to be used as depicted in FIG. 1. FIG. 3 is a schematic plan view depicting an internal configuration of the inkjet printer 1. FIG. 4 is a block diagram depicting an electrical configuration of the inkjet printer 1.

Referring to FIGS. 1-3, an example embodiment of an inkjet printer 1 (hereinafter, referred to as "printer 1") is disclosed. The printer 1 according to the illustrative embodiment may be an inkjet multifunction device that may be capable of performing multiple functions, for example, printing, scanning, copying, calling, and/or facsimile transmission and reception. As shown in the example embodiments of FIGS. 1-3, the printer 1 comprises a printer housing 2 and a cover 3 pivotably attached on the printer housing 2. Components of the printer 1 are described individually and more fully herein. Although the components are described with respect to the figures, it is known by one of ordinary skill in the art that the description of the positions and arrangements of components are not intended to be construed as limiting.

(Printer Housing)

As depicted in FIG. 3, a printer unit 4 is positioned in the printer housing 2. The printer unit 4 may be configured to print characters and/or an image on a recording sheet 100 (as an example of a medium). A configuration of the printer unit 4 is described in detail below.

As depicted in FIGS. 1 and 2, the printer housing 2 has an opening 2*a* in its front end. As shown, a feed cassette 6 that holds one or more recording sheets 100 therein may attach to a lower portion of the printer housing 2 in the opening 2*a*. A recording sheet 100 printed by the printer unit 4 may be discharged through the opening 2*a*, which is positioned above the feed cassette 6. Also shown is an operation panel 5 that is disposed on an upper portion of a forward portion of the printer housing 2. The upper portion of the forward portion of the printer housing 2 may be disposed above the opening 2*a*. The operation panel 5 may comprise a power button, operation keys such as numeric keys, and a display that may be arranged thereon. The front end portion of the printer housing 2 may have two slots 2*b* and 2*c*, into which two different kinds of media cards may be inserted, respectively, between the operation panel 5 and the opening 2*a*.

A receiver D may be disposed on an outer surface of the printer housing 2. A communication unit 7 may be disposed in a vertical position at a rear end portion of the printer housing 2. The communication unit 7 may be configured to wirelessly connect the printer 1 (what is called "base unit") and a handset (not depicted). The communication unit 7 may comprise an antenna 8 for transmission and reception.

An openable cover 9 may be attached to the printer housing 2. A holder 11, to which ink cartridges 10 may be attached, may be disposed behind the openable cover 9. As depicted in FIG. 3, a plurality of ink cartridges 10 storing ink may detachably attach to the holder 11. As illustrated, the printer 1 includes four ink cartridges 10, however the printer may store more or fewer ink cartridges. In some embodiments, the ink cartridges each store different colors, such as any combination of black, yellow, cyan, and magenta.

(Cover)

As depicted in FIG. 2, the cover 3 may be pivotably attached to the printer housing 2 by a hinge 12 disposed on the left end of the printer housing 2 so as to be movable up and down with respect to the printer housing 2. The cover 3 may cover, for example, the printer unit 4 positioned in the printer housing 2. Although a detailed description is omitted, the cover 3 may comprise a scanner unit 13 that may comprise an image scanner for capturing an image recorded on a document.

(Detailed Configuration of Printer Unit)

Next, the configuration of the printer unit 4 is described in detail. As depicted in FIG. 3, the printer unit 4 may comprise a platen 14, a carriage 15, an inkjet head 16, and a conveyor mechanism 17.

(Platen)

The platen 14 may be disposed in a horizontal posture in the printer housing 2. After a recording sheet 100 is drawn out from the feed cassette 6 (see FIGS. 1 and 2) and fed to the printer unit 4 by a sheet feed mechanism (not depicted), the recording sheet 100 may be placed on an upper surface of the platen 14.

(Carriage)

As depicted in FIG. 3, two guide rails 30 and 31 positioned in parallel are disposed above the platen 14 and extend in a horizontal, right-left direction (hereinafter, referred to as a "scanning direction"). The carriage 15 is driven by a carriage drive motor 32 (see FIG. 4) to move in the scanning direction along the two guide rails 30 and 31 within a range in which the carriage 15 faces the recording sheet 100 placed on the platen 14. The carriage 15 may be connected to the holder 11 by a tube (not depicted).

(Inkjet Head)

The inkjet head 16 is mounted on the carriage 15. The inkjet head 16 may have a plurality of nozzles 26 that open downward (e.g., toward a far side with respect to a sheet surface of the drawing sheet of FIG. 3). The inkjet head 16 may be known as a serial-type inkjet head that may eject ink toward a recording sheet 100 that is placed on the upper surface of the platen 14, while moving in the scanning direction together with the carriage 15.

Figure 5:
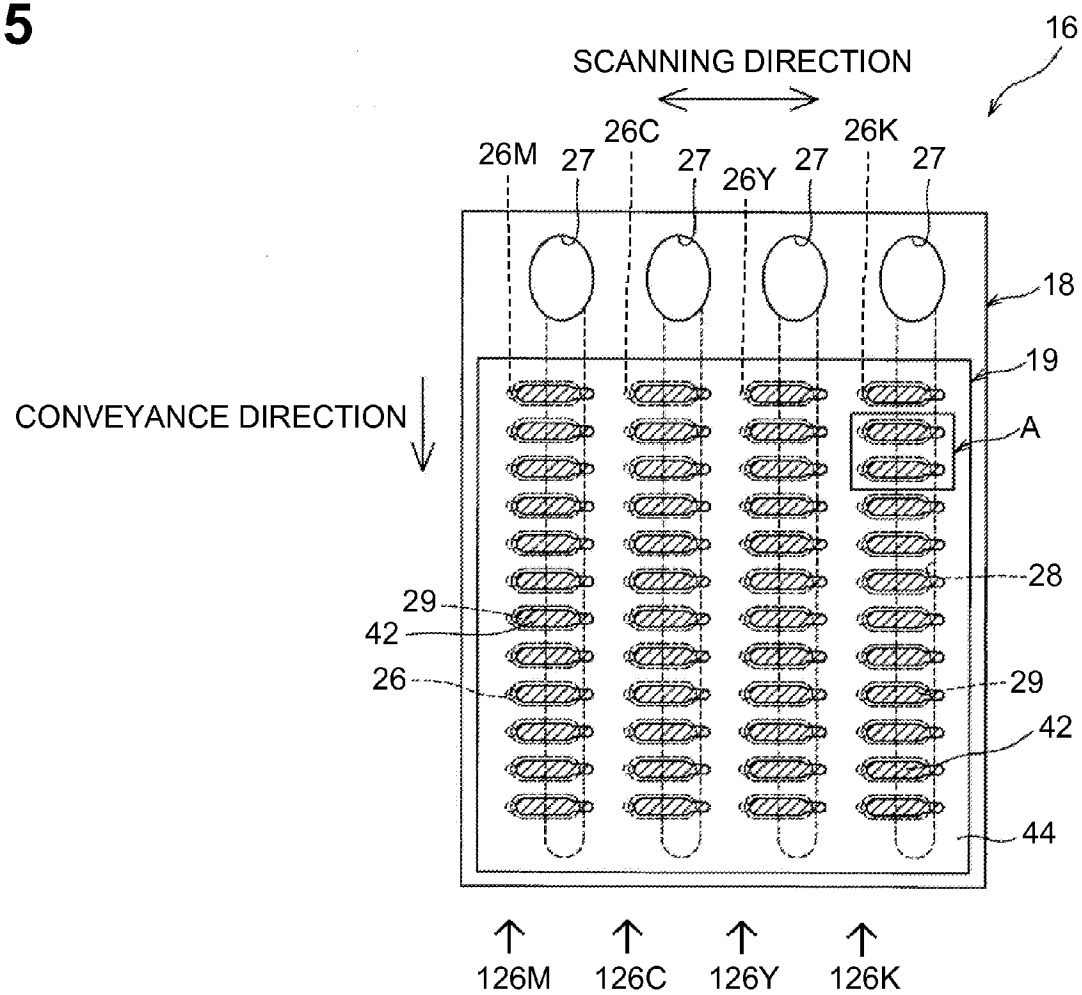
FIG. 5 is a plan view depicting an inkjet head in the illustrative embodiment according to one or more aspects of the disclosure.
Figure 6A:
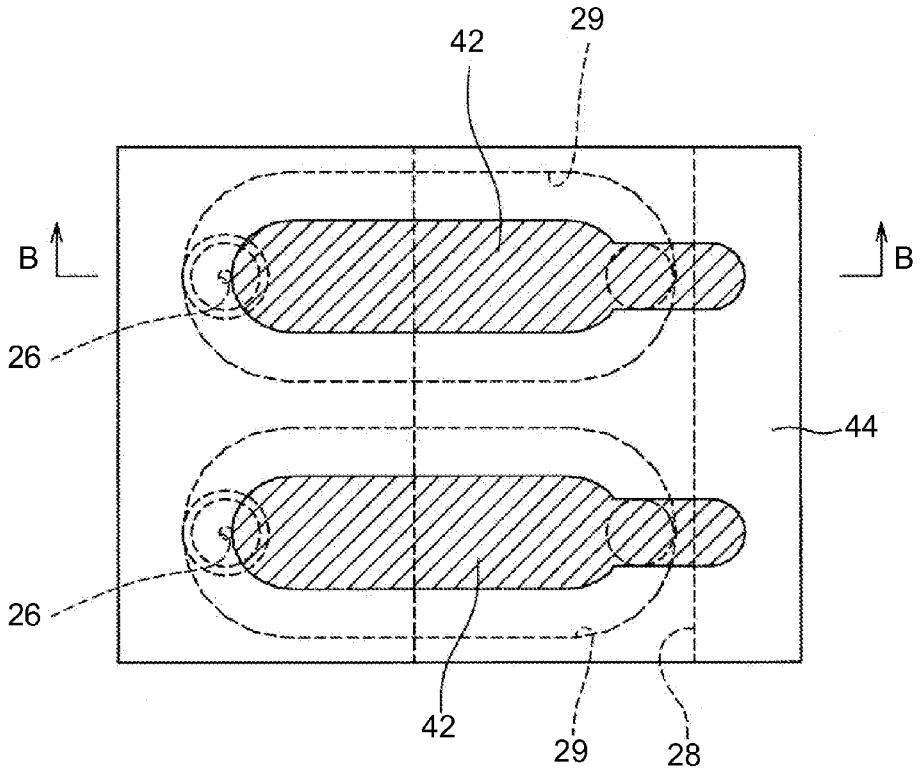
FIG. 6A is an enlarged view of a portion A in FIG. 5 in the illustrative embodiment according to one or more aspects of the disclosure.
Figure 6B:
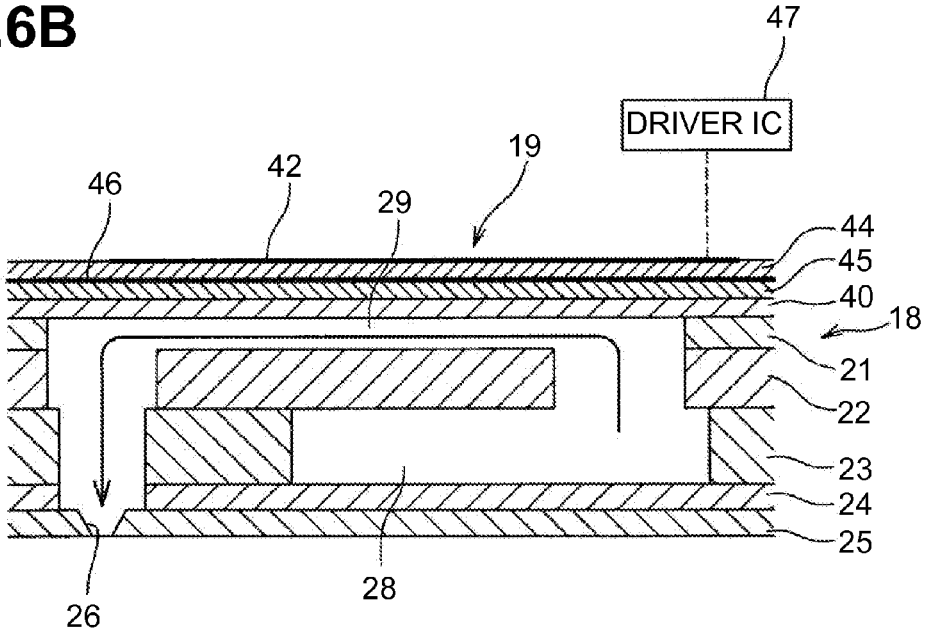
FIG. 6B is a sectional view taken along a line B-B of FIG. 6A in the illustrative embodiment according to one or more aspects of the disclosure.

A detailed configuration of the inkjet head 16 is now described. FIG. 5 is a plan view of the inkjet head 16. FIG. 6A is an enlarged view of a portion A in FIG. 5 and FIG. 6B is a sectional view taken along a line B-B of FIG. 6A. As depicted in FIGS. 5 and 6B, the inkjet head 16 may comprise a channel unit 18 and a piezoelectric actuator 19.

As depicted in FIG. 6B, the channel unit 18 may have a laminated structure comprising a plurality of, for example, five, plates 21, 22, 23, 24, and 25. The lowermost plate 25 of the five plates 21, 22, 23, 24, and 25 may be a nozzle plate having the plurality of nozzles 26 defined therein. The other four plates 21, 22, 23, and 24 may have, for example, pressure chambers 29 and manifolds 28 that may communicate with the plurality of nozzles 26, to provide channels in the channel unit 18.

As depicted in FIG. 5, a plurality of, for example, four, ink inlets 27 may be defined in an upper surface of the channel unit 18 and may be arranged side by side in the scanning direction. Ink of four colors stored in the respective ink cartridges 10 depicted in FIG. 3 may be supplied to the four ink inlets 27, respectively. The channel unit 18 may have a plurality of, for example, four, manifolds 28 defined therein. Each manifold 28 may be elongated in a direction perpendicular to the scanning direction (hereinafter referred to as a conveyance direction). The four manifolds 28 may be connected to the four ink inlets 27, respectively.

The channel unit 18 may further have the plurality of nozzles 26 and the plurality of pressure chambers 29 that may communicate with the plurality of nozzles 26, respectively. As depicted in FIG. 5, the plurality of nozzles 26 may be arranged in four rows corresponding to the four manifolds 28. In the same arrangement manner as the plurality of nozzles 26, the plurality of pressure chambers 29 may also be arranged in four rows corresponding to the four manifolds 28. As depicted in FIG. 6B, each pressure chamber 29 may communicate with a corresponding one of the manifolds 28. That is, as depicted in FIG. 6B, a plurality of individual channels may be defined in the channel unit 18, wherein each individual channel may branch off from a corresponding manifold 28 and connect to a corresponding nozzle 26 via a corresponding pressure chamber 29, as indicated by the arrow.

As depicted in FIG. 5, four rows of a plurality of nozzles 26 are shown, wherein each row may eject a different ink color. For example, the four rows of the plurality of nozzles 26 may comprise a black nozzle row 126K, an yellow nozzle row 126Y, a cyan nozzle row 126C, and a magenta nozzle row 126M. Accordingly, the black nozzle row 126K may comprise a group of nozzles 26K for ejecting black ink, the yellow nozzle row 126Y may comprise a group of nozzles 26Y for ejecting yellow ink, the cyan nozzle row 126C may comprise a group of nozzles 26C for ejecting cyan ink, and the magenta nozzle row 126M may comprise a group of nozzles 26M for ejecting magenta ink.

As depicted in FIGS. 5, 6A, and 6B, the piezoelectric actuator 19 may comprise a vibration plate 40, piezoelectric layers 44 and 45, a plurality of individual electrodes 42, and a common electrode 46. The vibration plate 40 may be joined to an upper surface of the channel unit 18 with covering the plurality of pressure chambers 29. The two piezoelectric layers 44 and 45 may be placed on an upper surface of the vibration plate 40. The plurality of individual electrodes 42 may be disposed on an upper surface of the upper piezoelectric layer 44 so as to face the plurality of pressure chambers 29, respectively. The common electrode 46 may be interposed between the piezoelectric layers 44 and 45 and may be laid over the plurality of pressure chambers 29.

A driver IC 47 may be connected to the plurality of individual electrodes 42. The driver IC 47 may provide a drive signal to each of the plurality of individual electrodes 42 in response to a signal from a control device 20 (see FIG. 4) of the printer 1.

When a drive signal is provided to a certain one of the individual electrodes 42 from the driver IC 47, piezoelectric deformation may occur in a portion of the upper piezoelectric layer 44 to cause the vibration plate 40 to deform and to warp toward the corresponding pressure chamber 29. At that time, a volume of the pressure chamber 29 may change, and this volume change may cause pressure to be applied to ink stored in a corresponding individual channel, thereby causing ink to be ejected from a corresponding nozzle 26.

As depicted in FIG. 3, the conveyor mechanism 17 may comprise two conveyor rollers 33 and 34. The conveyor rollers 33 and 34 may be arranged in the front-rear direction and the platen 14 and the carriage 15 may be interposed between the conveyor rollers 33 and 34. The two conveyor rollers 33 and 34 may be driven independently by a conveyor motor 35 (see FIG. 4) to convey a recording sheet 100 forward (e.g., in the conveyance direction) between the inkjet head 16 and the platen 14.

The inkjet head 16 ejects ink toward a recording sheet 100 placed on the platen 14 while moving in the scanning direction integrally with the carriage 15. The conveyor mechanism 17 conveys the recording sheet 100 by a predetermined amount in the conveyance direction by the two conveyor rollers 33 and 34. Accordingly, the inkjet head 16 performs an ink ejection operation and the conveyor mechanism 17 performs a conveyance operation to print a desired image and/or characters onto the recording sheet 100.

The printer 1 may comprise a temperature sensor 36 (see FIG. 4) for sensing a temperature (also referred to as "environmental temperature") inside the printer housing 2. An installation location of the temperature sensor 36 is not considered limiting. For obtaining an ink temperature, it may be preferable that the temperature sensor 36 may be disposed on the inkjet head 16 or on the carriage 15 equipped with the inkjet head 16. However, in alternative embodiments, the temperature sensor 36 may be positioned in other locations inside or external to the printer 1.

Control Configuration

Next, an electrical configuration of the printer 1 is described with reference to FIG. 4. As depicted in FIG. 4, the control device 20 (as an example of "control device") that may operate a whole control of the printer 1 may comprise a central processing unit ("CPU") 50, a read-only memory ("ROM") 51, a random-access memory ("RAM") 52, a non-volatile RAM ("NVRAM") 53, and an application-specific integrated circuit ("ASIC") 54. A facsimile interface ("FAX I/F") 55 and a network interface ("I/F") 56 may be connected to the ASIC 54 of the control device 20 as well as the printer unit 4 (e.g., the driver IC 47 of the inkjet head 16, the carriage drive motor 32, and the conveyor motor 35), the scanner unit 13, the operation panel 5 (e.g., the operation keys and the display). The FAX I/F 55 may allow the printer 1 to perform facsimile communication with another facsimile machine via a telephone line. The network I/F 56 may allow the printer 1 to access the Internet or on a local-area network ("LAN"). The control device 20 may receive signals from various sensors, for example, the temperature sensor 36 may sense the environmental temperature inside the printer housing 2.

The control device 20 may allow the CPU 50 and/or the ASIC 54 to perform various processes in accordance with various programs stored in the ROM 51. For example, the control device 20 may control operations of the portions of the printer unit 4. For example, the control device 20 may control an appropriate one of the FAX I/F 55 and the network I/F 56 to receive therethrough print data of a character and/or an image transmitted through facsimile communication via the telephone line or transmitted through the Internet or the LAN. Further, the control device 20 may control the printer unit 4 to print the character and/or the image on a recording sheet 100 based on the received print data. In the illustrative embodiment, the control device 20 may perform the various processes by the CPU 50 and/or the ASIC 54, for example. Nevertheless, the aspects of the disclosure might not be limited to this configuration. For example, in other embodiments, the control device 20 may be implemented by any hardware configuration. In one example, the processes may be performed by only one of the CPU 50 and the ASIC 54. In another example, the control device 20 may be implemented by which functions may be shared among two or more CPUs 50 and/or two or more ASICs 54.

The ROM 51 of the control device 20 may store information of a plurality of different print resolutions (e.g., 600 dpi, 1200 dpi, and 2400 dpi). The control device 20 may allow the printer unit 4 to perform printing at a print resolution selected from the plurality of different print resolutions stored in the ROM 51, in accordance with received print data. More specifically, it may be possible to perform printing at various print resolutions by controlling a drive frequency of the driver IC 47 of the inkjet head 16 (e.g., frequency of outputting a drive signal), a moving speed of the carriage 15 in the scanning direction, and a conveyance speed of a recording sheet 100, to adjust landing positions (e.g., dot positions) of ink ejected from the plurality of nozzles 26, respectively.

(Print Data Printing Control)

Figure 7:
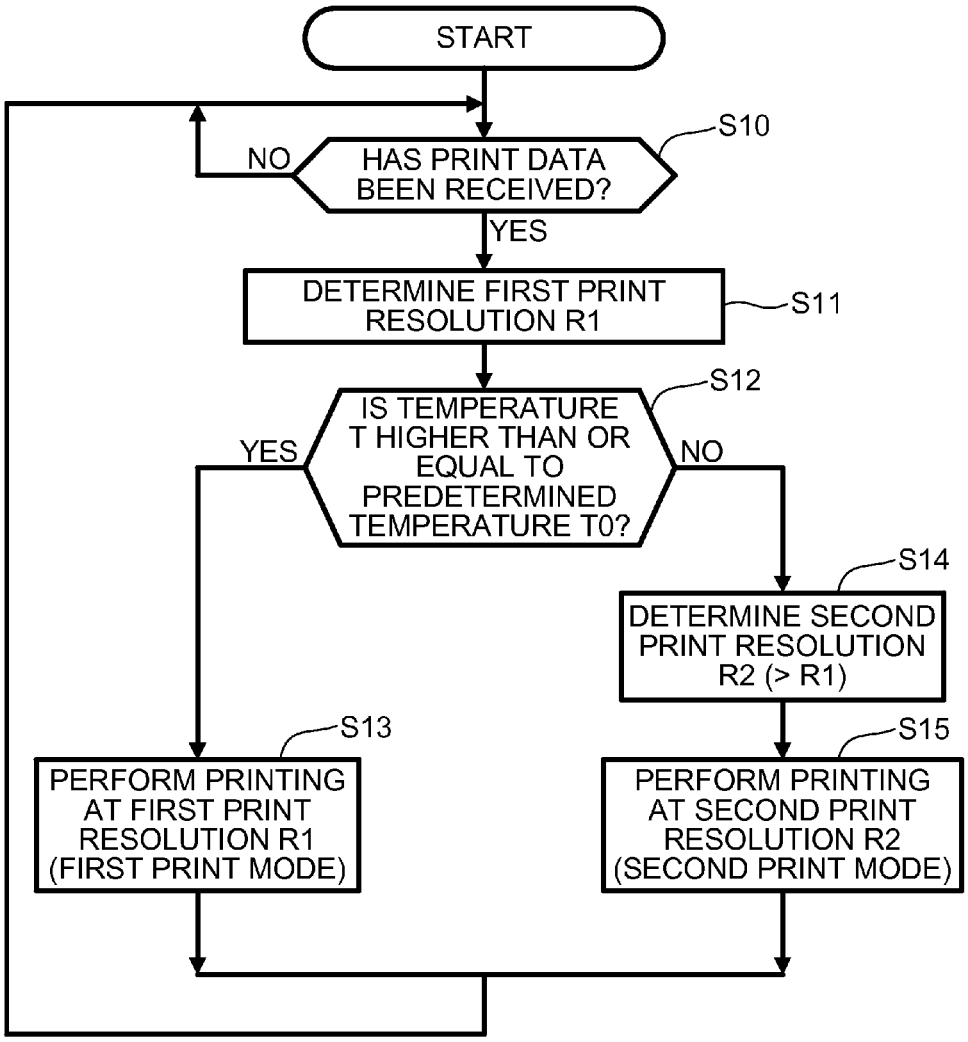
FIG. 7 is a flowchart depicting an example print data printing process in the illustrative embodiment according to one or more aspects of the disclosure.

FIG. 7 is a flowchart depicting a print data printing process. In particular, FIG. 7 describes a printing control performed by the control device 20 based on data received via facsimile communication. In FIG. 7, Si (i=10, 11, 12, . . . ) indicates a step number. While the power of the printer 1 is on, the print data printing process may loop and the routine may be on standby, waiting for receiving print data via facsimile communication (e.g., step S10). As depicted in FIG. 7, when the printer 1 receives print data from a facsimile machine via facsimile communication (e.g., YES in step S10), the control device 20 may store the print data in the RAM 52 temporarily.

The control device 20 may designate one of the plurality of print resolutions stored in the ROM 51, as a first print resolution R1, based on the print data stored in the RAM 52 (e.g., a resolution determination process in step S11). When the control device 20 determines that a temperature T sensed by the temperature sensor 36 is a predetermined temperature T0 or higher (e.g., 5° C. or higher) (e.g., YES in step S12), the control device 20 may allow the printer unit 4 comprising the inkjet head 16 to perform printing on a recording sheet 100 at the first print resolution R1 (e.g., a first or a normal print mode in step S13). A temperature at the predetermined temperature T0 or higher may be referred to as "normal condition" of the printer 1.

When the control device 20 determines that the temperature T sensed by the temperature sensor 36 is lower than the predetermined temperature T0 (e.g., NO in step S12), the control device 20 designates another of the plurality of print resolutions stored in the ROM 51 as a second print resolution R2 (e.g., step S14). The other print resolution, designated as the second print resolution R2 is higher than the first print resolution R1. Flow then proceeds to step S15 where the control device 20 instructs the printer unit 4 to perform printing onto a recording sheet 100 at the second print resolution R2 (e.g., a second or a low-temperature print mode in step S15). For example, when a resolution of 600 dpi is designated as the first print resolution R1, a resolution of 1200 dpi may be designated as the second print resolution R2. A temperature below the predetermined temperature T0 may be referred to as "low-temperature condition" of the printer 1. When the printing onto the recording sheet 100 is completed, the routine may return to step S10 to receive additional print data.

In FIG. 7, after print data is received via facsimile communication (e.g., step S10), the first print resolution R1 is determined (e.g., step S11) and then the print mode is selected based on the result of the comparison between the temperature T and the predetermined temperature T0 (e.g., step S12). In other embodiments, for example, after print data is received via facsimile communication, the selection of the print mode may be performed prior to the designation of the first print resolution R1. When the normal print mode is selected, the first print resolution R1 may be determined based on the received print data. When the low-temperature print mode is selected, the second print resolution R2 may be determined based on the received print data, wherein a print resolution determined as the second print resolution R2 may be higher than a print resolution determined as the first print resolution R1 when the normal print mode is selected.

Figure 8A:
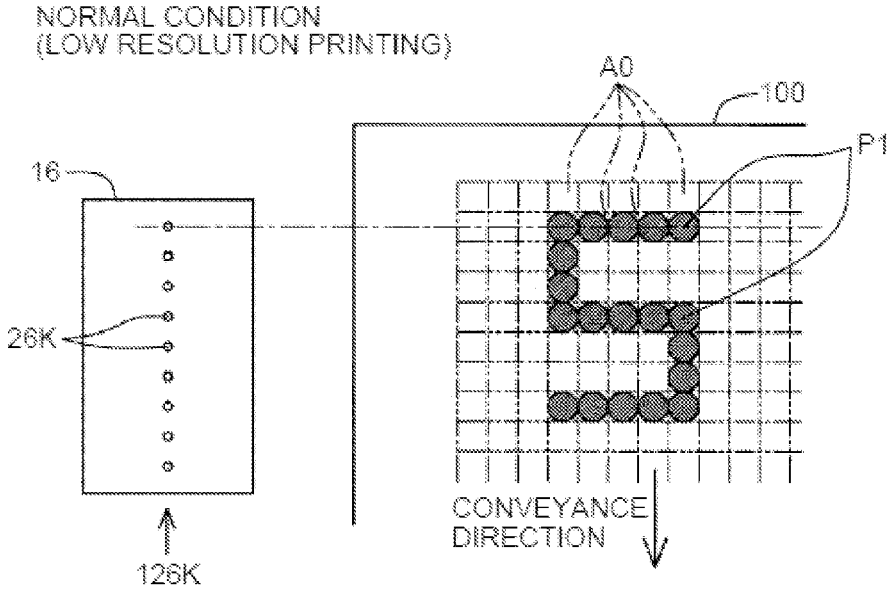
FIG. 8A illustrates a character printed in a normal print mode in the illustrative embodiment according to one or more aspects of the disclosure.
Figure 8B:
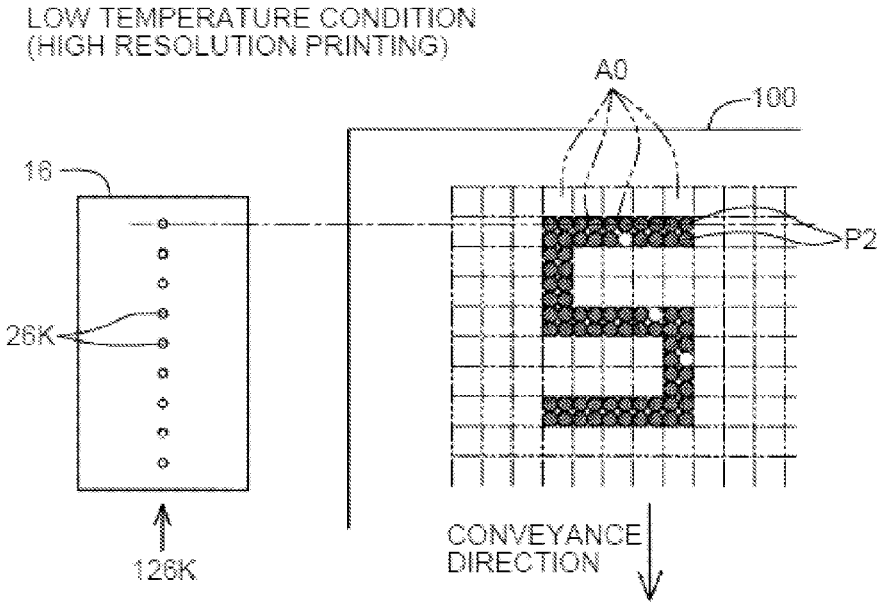
FIG. 8B illustrates a character printed in a low-temperature print mode in the illustrative embodiment according to one or more aspects of the disclosure.

The normal print mode, which may be a low-resolution print mode that is selected under the normal condition and the low-temperature print mode, which may be a high-resolution print mode that is selected under the low-temperature condition are further described in detail. FIG. 8A illustrates a character printed in the normal print mode, and FIG. 8B illustrates a character printed in the low-temperature print mode. In FIGS. 8A and 8B, for the sake of simplicity of the drawing, only the black nozzle row 126K is depicted, although the inkjet head 16 comprises four nozzles rows 126K, 126Y, 126C, and 126M, each corresponding to ink of four different colors. In other embodiments, more or fewer nozzle rows are used. Further, for the sake of simplicity, a simple configuration in which the black nozzle row 126K consists of nine nozzles 26K is shown as an example.

As depicted in FIG. 8A, in the normal print mode, one dot may be formed in one dot formation area A0, defined on a recording sheet 100, by ejection of ink from one of the nozzles 26K. A "dot formation area A0" refers to a potential area to be formed with a single dot on a recording sheet 100 at the first print resolution R1 selected under the normal condition. In FIGS. 8A and 8B, each "dot formation area A0" may be indicated by one of square areas divided by phantom lines in a grid pattern. For example, when a resolution of 600 dpi is determined as the first print resolution R1, a distance between two adjacent dot formation areas A0 (e.g., a distance between centers of surface areas) is 600 dpi. FIG. 8A depicts an example of printing a number "5" consisting of a total of 19 dots P1.

As depicted in FIG. 8B, in the low-temperature print mode, a plurality of dots P2 may be formed in one dot formation area A0, which was previously defined in the normal print mode. In typical high-resolution printing, it may be sufficient that a plurality of dots P2 are merely formed in one dot formation area A0 defined for the low-resolution printing. Nevertheless, in the illustrative embodiment, a plurality of dots P2 may be formed in the one dot formation area A0 by ejection of ink from appropriately selected nozzles of the plurality of nozzles 26. More specifically, ink may be ejected from four of the plurality of nozzles 26 on four corner areas, respectively, of one dot formation area A0 to form a total of four dots P2 in the one dot formation area A0. The four dots P2 may be arranged in a two-by-two matrix in the one dot formation area A0. Additionally shown is a situation in which some dots P2 are missing due to ejection failure (e.g., one or more of the nozzles 26K are unable to eject ink therefrom) caused in one or more of the nozzles 26K by low temperature.

FIGS. 9A to 9D are diagrams for explaining an example dot formation operation with respect to dot formation areas in the low-temperature print mode. In FIGS. 9A to 9D, four dots P2 may be formed in each appropriate one of the dot formation areas A0 using four of the nozzles 26K. The four nozzles (e.g., nozzles 26Ka, 26Kd, 26Kf, and 26Ki) used in the dot formation operation might not be adjacent to one another in the black nozzle row 126K. Although this example illustrates ejection of four dots on each one dot formation area, in other embodiments, other quantities of dots may alternatively be ejected on each one dot formation area.

Figure 9A:
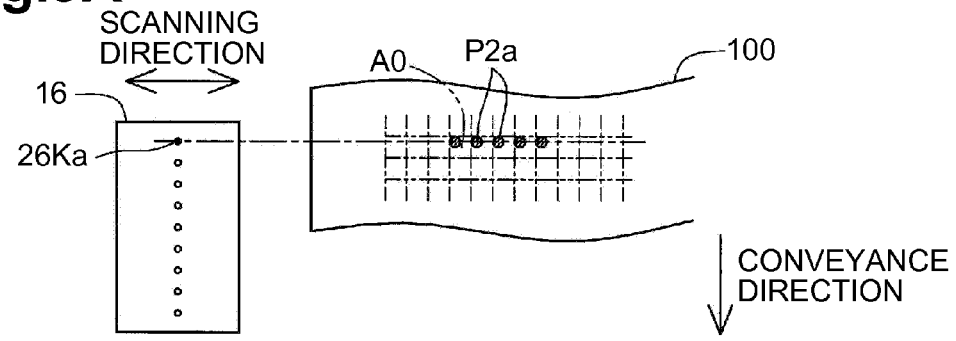
FIGS. 9A, 9B, 9C, and 9D are diagrams for explaining an example dot formation operation performed on dot formation areas in the low-temperature print mode in the illustrative embodiment according to one or more aspects of the disclosure.
Figure 9B:
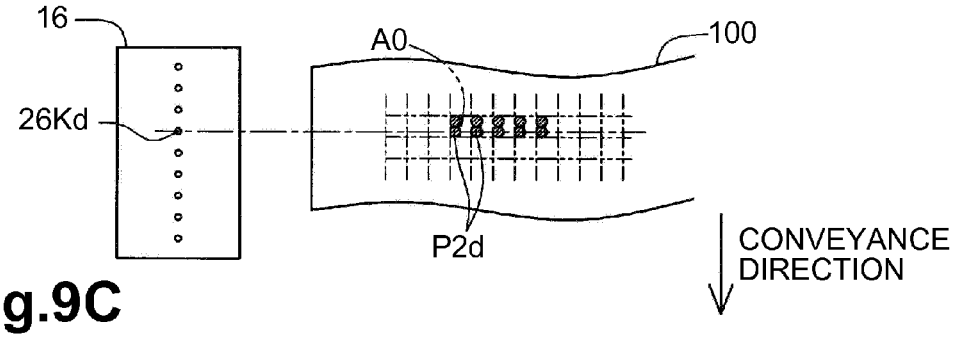
Figure 9C:
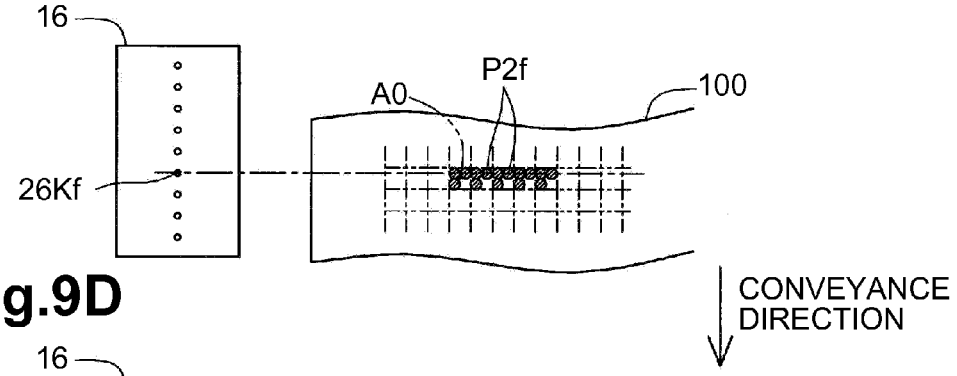
Figure 9D:
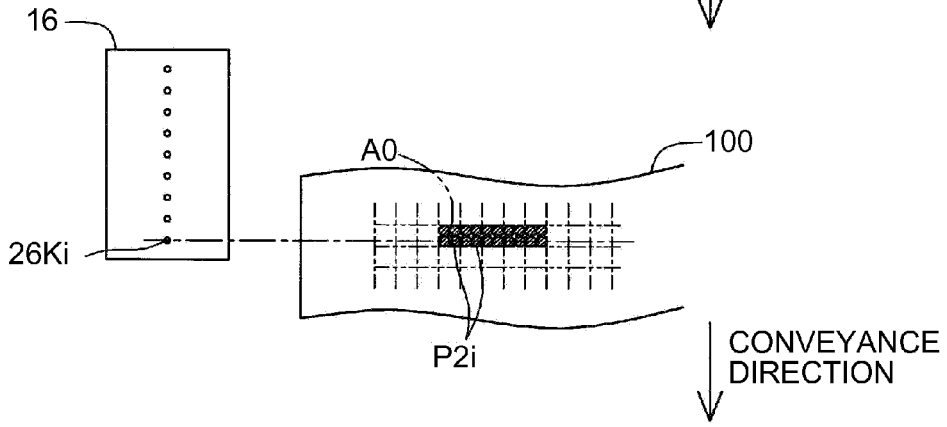

FIGS. 9A to 9D illustrates the dot formation operation by forming the horizontal line of the number "5", as depicted in FIG. 8B, as a simplified example. As shown in this example, the horizontal line of the number "5" extends over five dot formation areas A0. First, as depicted in the example illustrated in FIG. 9A, as the inkjet head 16 moves in the scanning direction, the inkjet head 16 ejects ink from a first nozzle (e.g., a nozzle 26Ka) located at a most upstream end in the black nozzle row 126K in the conveyance direction to form a dot P2*a* at an upper left position in each of the five dot formation areas A0. Next, as depicted in FIG. 9B, after the recording sheet 100 is conveyed by the conveyor mechanism 17, the inkjet head 16 ejects ink from a fourth nozzle (e.g., a nozzle 26Kd) ordered from the upstream end in the conveyance direction, to form a dot P2*d* at a lower left position in each of the five dot formation areas A0. Further, as depicted in FIG. 9C, after the recording sheet 100 is conveyed by the conveyor mechanism 17 again, the inkjet head 16 may eject ink from a sixth nozzle (e.g., a nozzle 26Kf) ordered from the upstream end in the conveyance direction, to form a dot P2*f* at an upper right position in each of the five dot formation areas A0. Finally, as depicted in FIG. 9D, after the recording sheet 100 is conveyed by the conveyor mechanism 17, the inkjet head 16 may eject ink from a last nozzle (e.g., a nozzle 26Ki) located at a most downstream end in the black nozzle row 126K in the conveyance direction to form a dot P2*i* at a lower right position in each of the five dot formation areas A0.

In the example shown in FIG. 8B, a distance between adjacent dots P2 may be half of the distance between adjacent dots P1 as shown in FIG. 8A. For example, when a resolution of 600 dpi is designated as the first print resolution R1 in FIG. 8A, a resolution of 1200 dpi may be designated as the second print resolution R2 in FIG. 8B. Although consisting of 19 dots in FIG. 8A, the number "5" may consist of 76 dots in FIG. 8B and may be a high-definition character.

As described above, in the low-temperature print mode, a plurality of dots P2 may be formed in a one dot formation area A0 by ejection of ink from appropriately selected nozzles of the plurality of nozzles 26. Therefore, when ejection failure occurs in one or more nozzles due to low temperature, resulting in a failure to eject ink therefrom, some dots P2 that are intended to form fail to form, as depicted in FIG. 8B. However, dots P2 may still be formed in the dot formation area A0 by the other, functional nozzles, which are also expected to eject ink toward the dot formation area A0. Thus, there is a lower likelihood that no dot P2 is formed in a dot formation area A0 where a dot P1 should be formed, resulting in a reduced possibility that a printed character and/or a printed image is illegible. That is, in the case depicted in FIG. 8A, if some of the dots P1 are missing, it may be hard to identify the printed character as the number "5". On the other hand, in the case depicted in FIG. 8B, even when some of the dots P2 are missing, an illegible condition in which it may be impossible to identify the character as the number "5" may occur less frequently due to a reduced probability of ejection failure occurring in each of the selected nozzles for ejecting ink.

Figure 10:
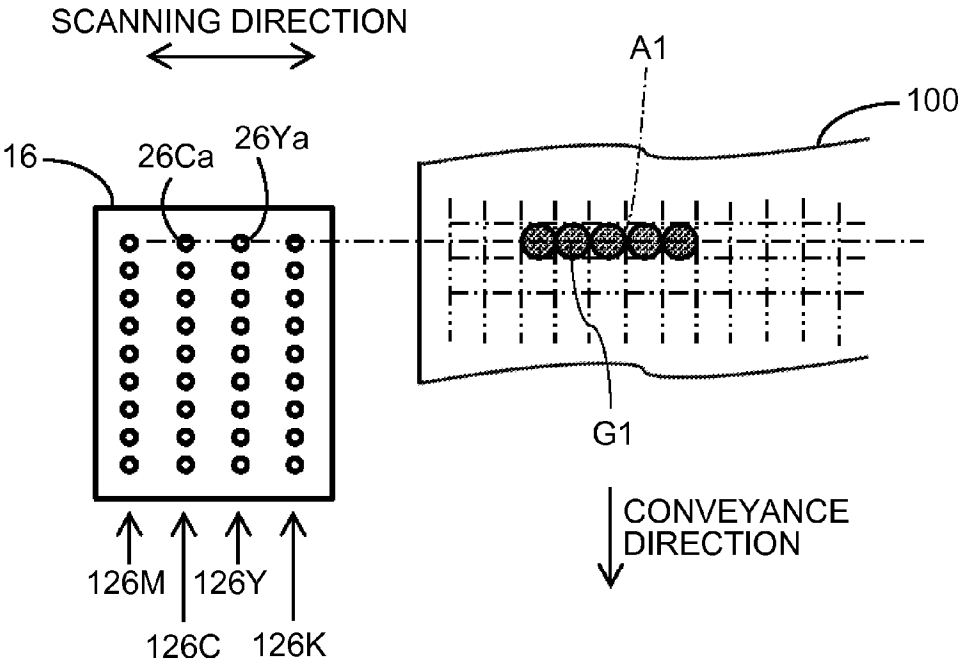
FIG. 10 is a diagram for explaining an example dot formation operation performed in the normal print mode in the illustrative embodiment according to one or more aspects of the disclosure.

In the above-described example, the printing performed described nozzles a single nozzle row. However, printing may additionally be performed using nozzles from a plurality of nozzle rows. In a case where color print data is received via facsimile communication and printing of the received print data is performed in color, for example, a green character may be printed. The green character may be formed with one or more green dots that may be formed by a blend of yellow ink and cyan ink. Therefore, in the normal print mode, as depicted in FIG. 10, one drop of yellow ink may be ejected toward a dot formation area A1 defined on a recording sheet 100 from a nozzle 26Ya of the yellow nozzle row 126Y and one drop of cyan ink may be ejected toward the dot formation area A1 from a nozzle 26Ca of the cyan nozzle row 126C, thereby forming one green dot G1.

Figure 11A:
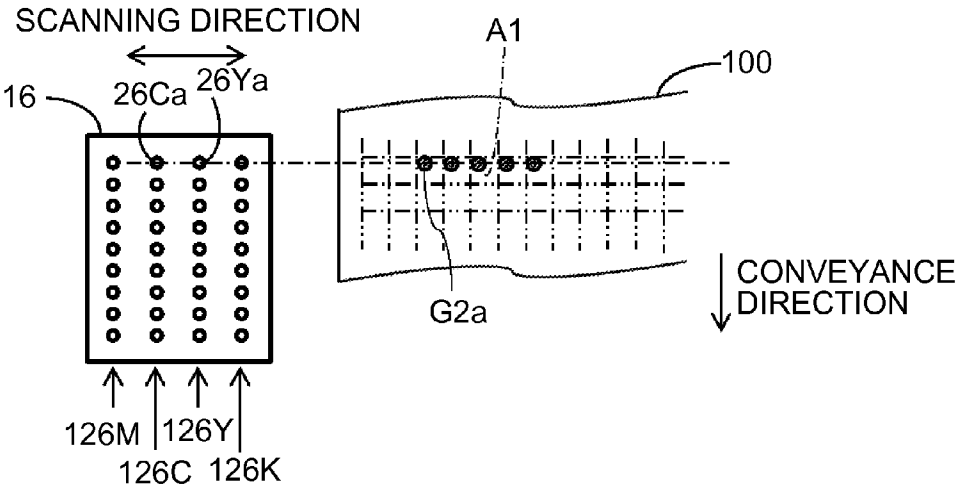
FIGS. 11A, 11B, 11C, and 11D are diagrams illustrating an example dot formation operation performed on dot formation areas in the low-temperature print mode in the illustrative embodiment according to one or more aspects of the disclosure.
Figure 11B:
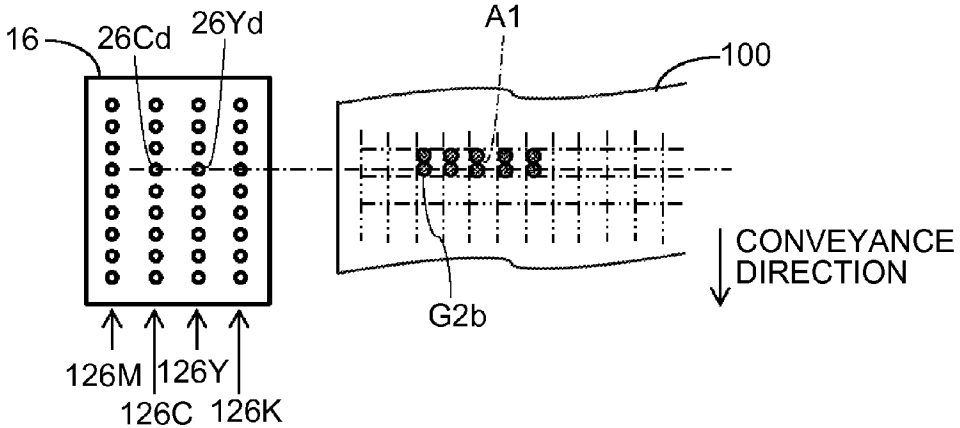
Figure 11C:
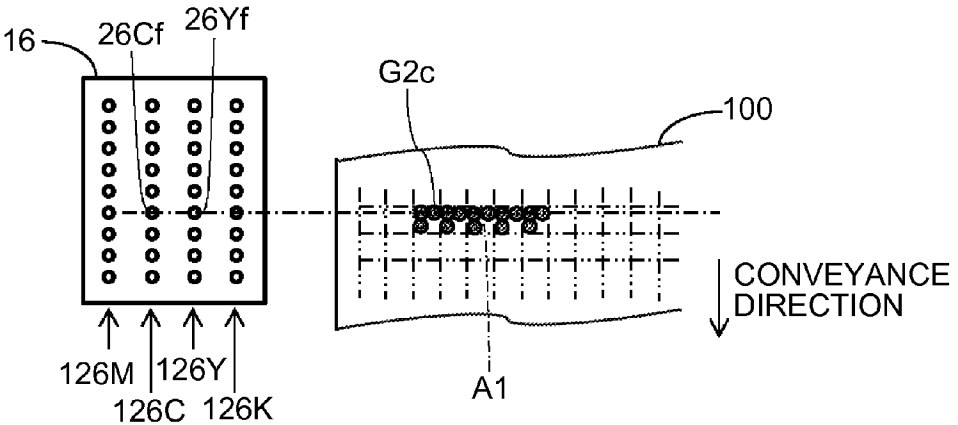
Figure 11D:
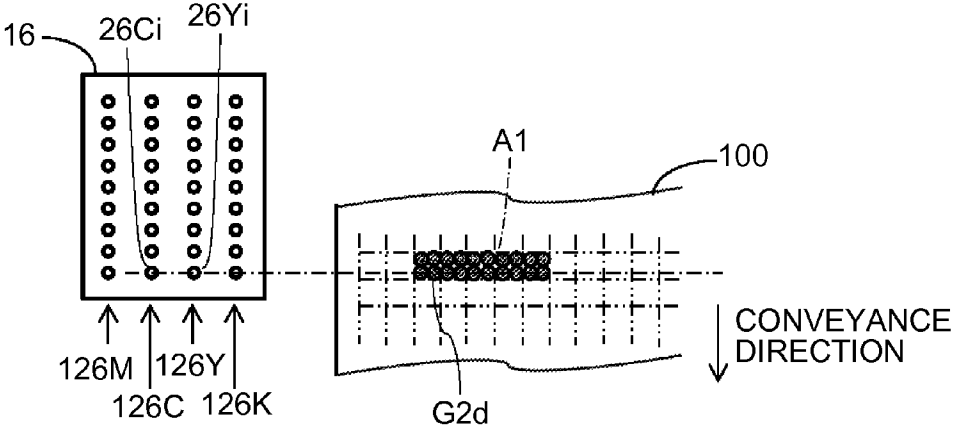
Figure 12A:
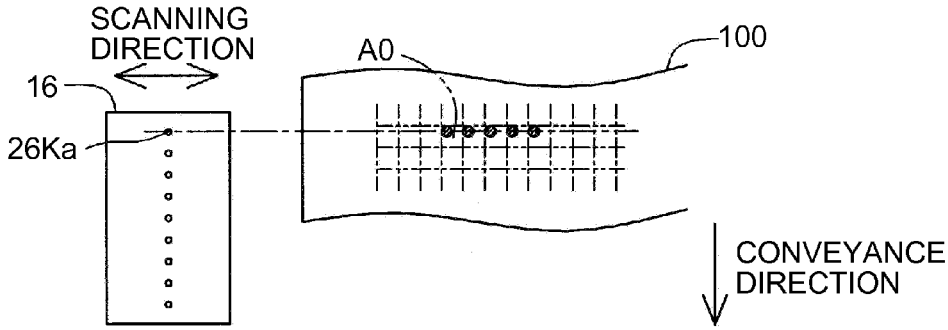
FIGS. 12A, 12B, 12C, and 12D are diagrams corresponding to FIGS. 9A, 9B, 9C, and 9D, respectively, in a first variation of the illustrative embodiment according to one or more aspects of the disclosure.
Figure 12B:
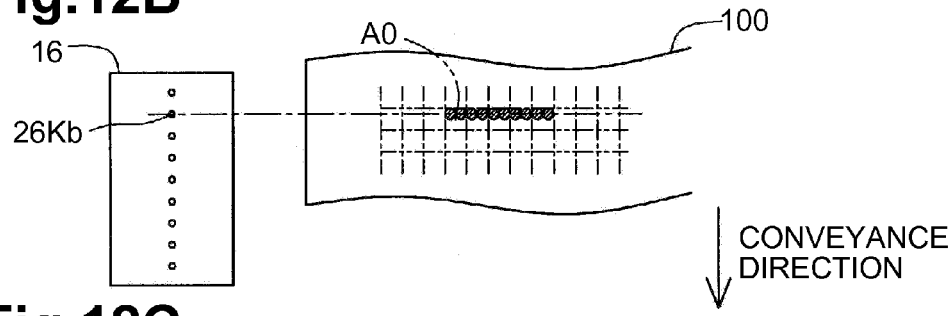
Figure 12C:
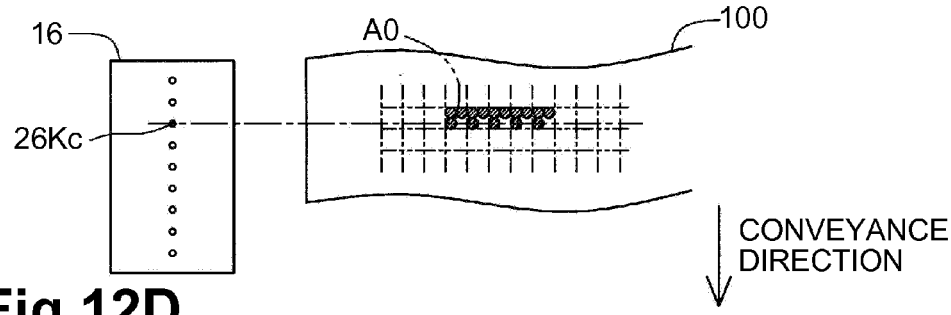
Figure 12D:
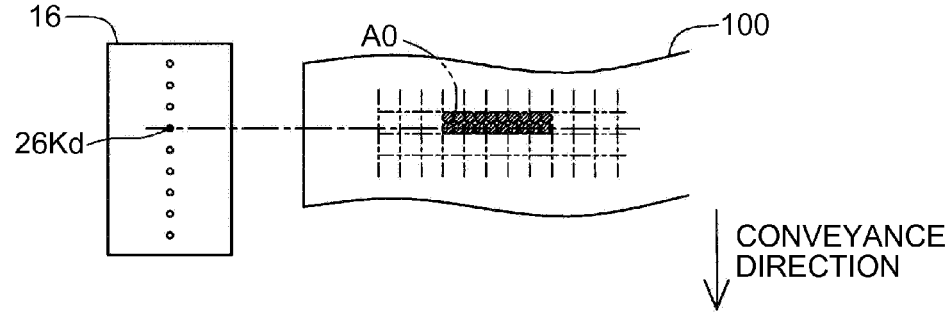

In the low-temperature print mode, as depicted in FIG. 11A, one drop of yellow ink may be ejected from the nozzle 26Ya toward a position in a dot formation area A1 and one drop of cyan ink may be ejected from the nozzle 26Ca toward the same position where the yellow ink, ejected from the nozzle 26Ya, landed in the dot formation area A1, thereby forming a green dot G2*a* in the dot formation area A1. Then, as depicted in FIG. 11B, one drop of yellow ink may be ejected from a nozzle 26Yd toward another position in the same dot formation area A1 and one drop of cyan ink may be ejected from a nozzle 26Cd toward the same position where the yellow ink, ejected from the nozzles 26Yd, landed in the dot formation area A1, thereby forming another green dot G2*b* in the dot formation area A1. As depicted in FIG. 11C, one drop of yellow ink may be ejected from a nozzle 26Yf toward a yet another position in the same dot formation area A1 and one drop of cyan ink may be ejected from a nozzle 26Cf toward the same position where the yellow ink, ejected from the nozzles 26Yf, landed in the dot formation area A1, thereby forming a another green dot G2*c* in the dot formation area A1. Finally, as depicted in FIG. 11D, one drop of yellow ink may be ejected from a nozzle 26Yi toward a yet another position in the same dot formation area A1 and one drop of cyan ink may be ejected from a nozzle 26Cf the same position where the yellow ink, ejected from the nozzles 26Yi, landed in the dot formation area A1, thereby forming a yet another green dot G2*d* in the dot formation area A1.

In the normal print mode, a total of two drops of yellow ink and cyan ink are ejected toward one dot formation area A1. Alternatively, in the low-temperature print mode, a total of eight drops, a combination of yellow ink and cyan ink, are ejected toward one dot formation area A1. Accordingly, the number of ink droplets ejected toward a single dot formation area A1 in the low-temperature print mode may be (e.g., six drops) greater than that in the normal print mode. Thus, there is a higher possibility that at least one dot is formed on one dot formation area A1 in the low-temperature print mode as compared with the normal print mode.

In other embodiments, for example, in order to prevent or reduce the occurrence of one or more missing dots in a single dot formation area A0, it may be acceptable to eject ink toward the same position (e.g., the center of the surface area) in a single dot formation area A0 from each of the selected nozzles of the plurality of nozzles 26 in the low-temperature print mode. Nevertheless, in the low-temperature print mode, a print resolution that may be higher than the print resolution used in the normal print mode may be designated and ink may be ejected from the selected nozzles of the plurality of nozzles 26 toward a plurality of different positions (e.g., four positions in FIG. 8B) to form a plurality of dots P2 in a single dot formation area A0. Accordingly, a character may be printed at higher resolution and thus printing quality may be increased in the low-temperature print mode as compared to the normal print mode.

Under the low-temperature condition, a group of adjacent or nearby nozzles of the plurality of nozzles 26 may similarly experience ejection failure (e.g., are unable to eject ink therefrom) at the same time because the adjacent or nearby nozzles 26 are exposed to similar conditions, such as ink temperature and humidity. As such, in the illustrative embodiment, as depicted in FIGS. 9A to 9D, ink may be ejected toward a dot formation area A0 defined on a recording sheet 100 from four nozzles 26K (e.g., the nozzles 26Ka, 26Kd, 26Kf, and 26Ki) that are not adjacent to one another in the black nozzle row 126K. This configuration may reduce the possibility that each of the four selected nozzles 26 will experience ejection failure (e.g., are unable to eject ink therefrom) at the same time. Further, the four nozzles 26K may comprise the endmost nozzles 26Ka and 26Ki that may be located at the both ends in the black nozzle row 126K, thereby further reducing the possibility that the ejection failure occurs in each of the four nozzles 26K at the same time.

Next, variations of the illustrative embodiment are described. Common parts have the same reference numerals as those of the illustrative embodiment, and the detailed description of the common parts is omitted.

First Example Variation

In this example embodiment, the combination of nozzles 26 to be used to eject ink toward a dot formation area A0 defined on a recording sheet 100 in the low-temperature print mode under the low-temperature condition is not be limited to the described embodiment (e.g., a first variation).

For example, in the illustrative embodiment, four non-adjacent nozzles 26Ka, 26Kd, 26Kf, and 26Ki within the black nozzle row 126K are used. However, in other embodiments, as depicted in FIGS. 12A to 12D, alternative four nozzles 26K (e.g., nozzles 26Ka, 26Kb, 26Kc, and 26Kd) that may be adjacent to one another in the black nozzle row 126K may be used. Ink may be ejected toward a dot formation area A0 from selected nozzles, which may eject ink of different colors (e.g., in the case where selected nozzles belong to different nozzle rows).

Second Example Variation

In this example embodiment, the an amount of ink to be ejected from each nozzle 26 differs between the normal print mode and the low-temperature print mode. For example, ink may tend to blur when printing is performed at higher print resolution. Therefore, it may be common practice that the amount of ink to be ejected from each nozzle 26 is decreased with increases in the print resolution.

Figure 13:
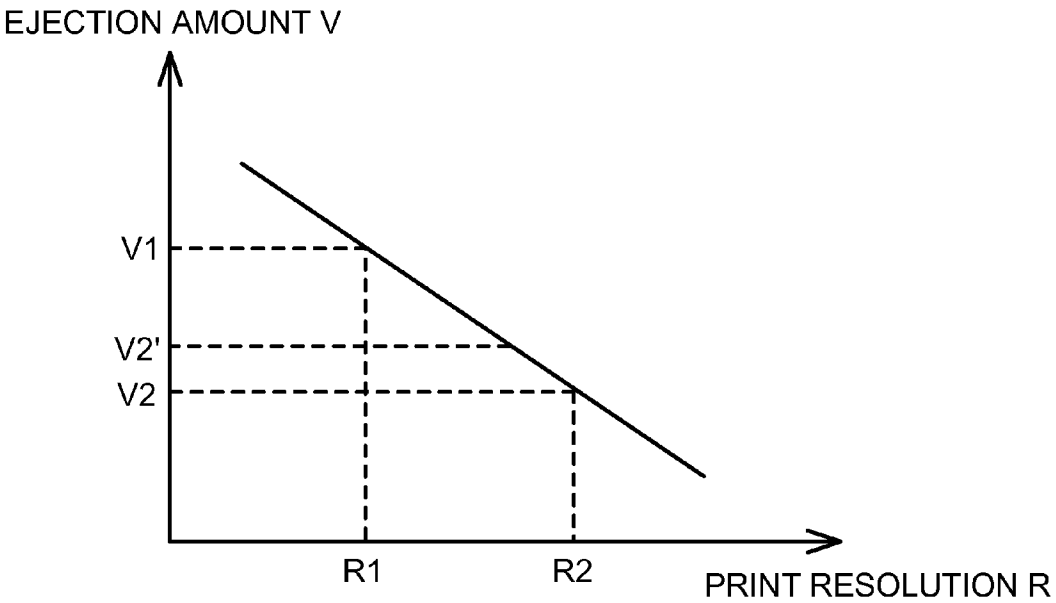
FIG. 13 is a diagram depicting ejection amount information in second and third variations of the illustrative embodiment according to one or more aspects of the disclosure.

An embodiment according to the second variation is described in detail. As depicted in FIG. 13, information indicating a relationship between a print resolution and an amount of ink ejected from each nozzle 26 (hereinafter, referred to as "ejection amount information") may be maintained (stored) in the ROM 51 of the control device 20. The control device 20 may instruct the printer unit 4 to perform printing in one of the normal print mode and the low-temperature print mode in accordance with a flowchart depicted in FIG. 14.

Figure 14:
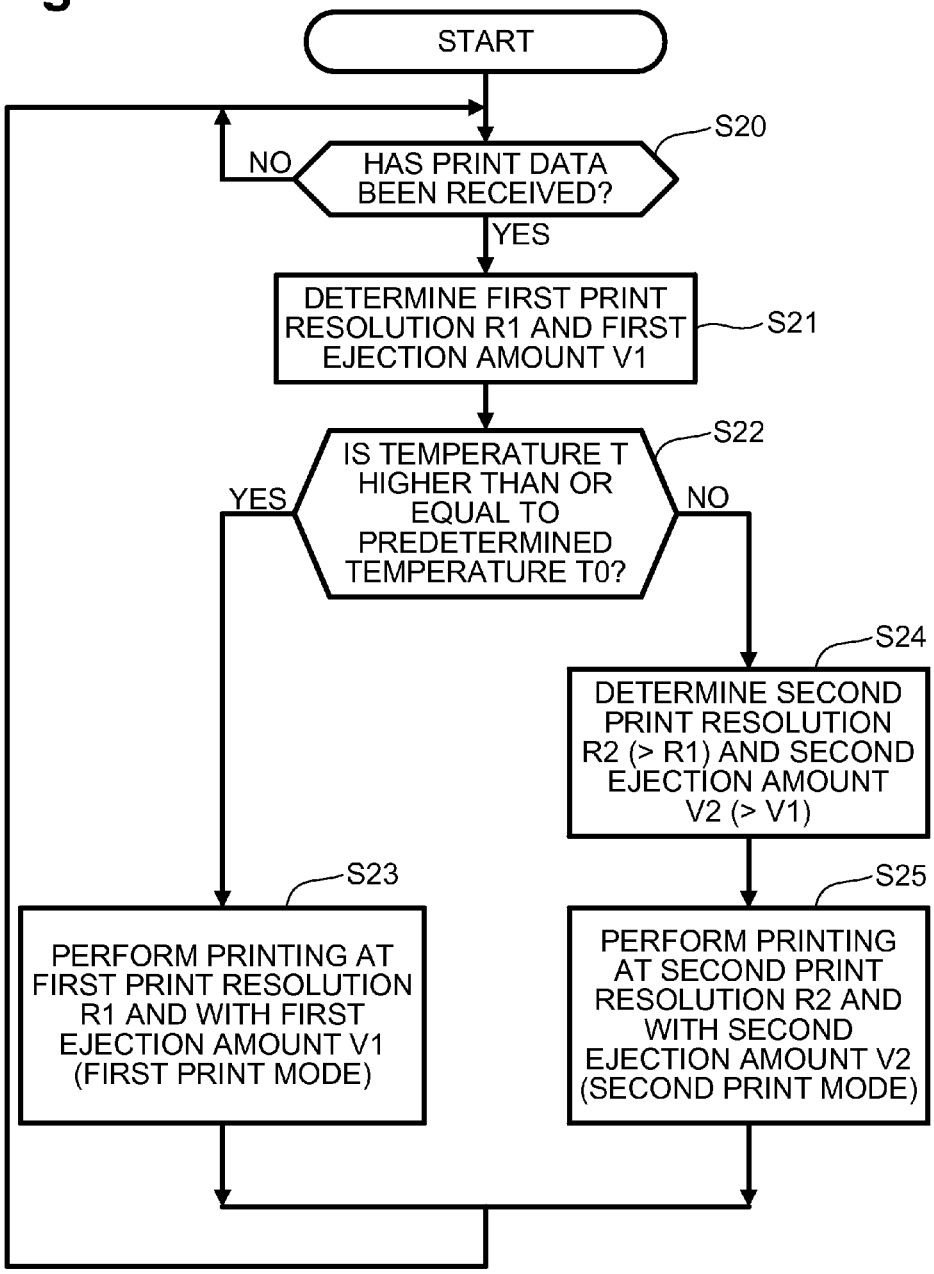
FIG. 14 is a flowchart depicting an example print data printing process in the second variation of the illustrative embodiment according to one or more aspects of the disclosure.

As depicted in FIG. 14, when print data is received via facsimile communication (e.g., YES in step S20), the control device 20 may designate the first print resolution R1 based on the print data and also designate an ejection amount (e.g., a first ejection amount V1) of each nozzle 26 based on the ejection amount information depicted in FIG. 11 (e.g., step S21). When the control device 20 determines that the printer 1 is under the normal condition in which the temperature T is at or above the predetermined temperature T0 (e.g., YES in step S22), the control device 20 may instruct the printer unit 4 to print on a recording sheet 100 with the first print resolution R1 and the first ejection amount V1 (e.g., normal print mode in step S23).

When the control device 20 determines that the printer 1 is under the low-temperature condition in which the temperature T is lower than the predetermined temperature T0 (e.g., NO in step S22), the control device 20 may designate a second print resolution R2 that is higher than the first print resolution R1, and may also designate an ejection amount (e.g., a second ejection amount V2) of each nozzle 26 based on the ejection amount information depicted in FIG. 13 (e.g., step S24). The second print resolution R2 may be higher than the first print resolution R1 (i.e., second print resolution R2>first print resolution R1). Therefore, based on the ejection amount information depicted in FIG. 13, the second ejection amount V2 may be less than the first ejection amount V1 (i.e., second ejection amount V2<first ejection amount V1). For example, when a resolution of 600 dpi and an ejection amount of 36 pl are designated as the first print resolution R1 and the first ejection amount V1, respectively, a resolution of 1200 dpi and an ejection amount of 8 pl may be designated as the second print resolution R2 and the second ejection amount V2, respectively.

Third Example Variation

In this example embodiment, the control device 20 designates a value (V2) (e.g., in step S24 of the second variation), obtained based on the ejection amount information depicted in FIG. 13, as the second ejection amount for the low-temperature print mode, in a similar manner in which the value V1 may be designated as the first ejection amount for the normal print mode. Nevertheless, when the low-temperature print mode is selected under the low-temperature condition, one or more nozzles 26 that may be used to eject ink toward a dot formation area A0 may have a problem with ejecting ink. When such a situation occurs, a smaller amount of ink may land on the dot formation area A0 than expected. Therefore, the control device 20 may designate a value (V2') that may be larger than the value (V2) obtained based on the second print resolution R2 and the ejection amount information of FIG. 13, as the second ejection amount for the low-temperature print mode. Therefore, even when the one or more nozzles 26 have a problem with ejection due to low temperature, such control of the ejection amount may prevent or reduce an occurrence of a problem that a dot size may become smaller than the expected size. For example, when a resolution of 1200 dpi is designated as the second print resolution R2 under a condition where a resolution of 600 dpi and an ejection amount of 36 pl are designated as the first print resolution R1 and the first ejection amount V1, respectively, a value V2' (e.g., 16 pl) may be designated as the second ejection amount, instead of the value V2 (e.g., 8 pl), obtained based on the ejection amount information.

There may be a case where ejection failure might not occur in any of the nozzles 26 although the printer 1 is under the low-temperature condition. When ejection failure does not occur in any of the nozzles 26, a large amount of ink may be ejected toward a dot formation area A0 and thus ink may tend to blur because the value V2' that is larger than the value V2 is designated as the second ejection amount for the low-temperature print mode. Nevertheless, in the third variation, a greater importance may be placed on the risk of a dot being faded due to an insufficient amount of ink landing on one dot formation area A0. Therefore, although a larger amount of ink than necessary lands on the dot formation area A0, the risk that a character and/or an image may become illegible due to a faint dot may be prevented or reduced.

In the second variation and the third variation, the ejection amount information may associate other information related to the ejection amount with the print resolution, rather than associating the print resolution and the ejection amount to each other directly. For example, it may be assumed that the driver IC 47 of the inkjet head 16 is capable of generating drive signals of a plurality of types that are different in drive voltage and/or drive waveform for each of the ejection amounts. In this case, the ejection amount information may associate the plurality of print resolutions and the plurality of drive signals with each other.

Fourth Example Variation

In this illustrative embodiment, in the low-temperature print mode under the low-temperature condition, ink may be ejected toward a plurality of respective positions in a dot formation area A0 from selected nozzles of the plurality of nozzles 26 to form a plurality of dots P2 in the dot formation area A0 (see FIG. 8B). In other embodiments, ink may be ejected toward the same position in a dot formation area A0 from selected nozzles of the plurality of nozzles 26 (e.g., fourth variation). In this case, there may be less possibility that no dot is formed on one dot formation area A0, thereby entirely preventing or reducing the occurrence of the problem that a printed character and/or a printed image may become illegible. Nevertheless, in the fourth variation, only one dot P2 may be formed in a one dot formation area A0 in the low-temperature print mode. Accordingly, the print resolution may be the same in both the normal print mode and the low-temperature print mode.

Figure 15:
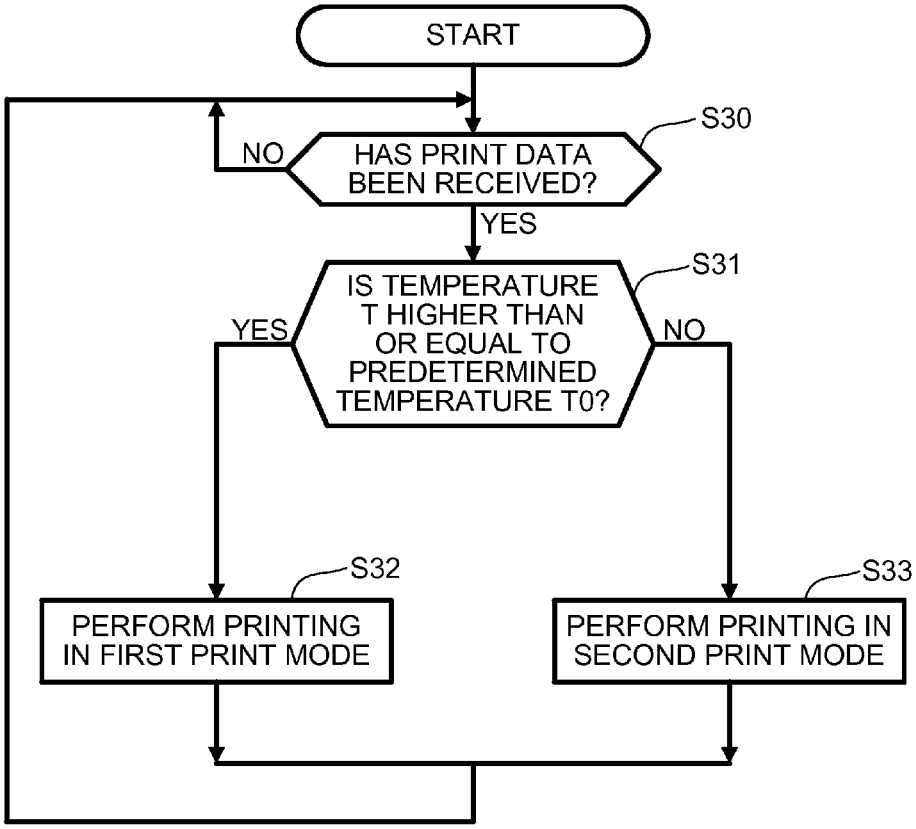
FIG. 15 is a flowchart depicting an example print data printing process in a fourth variation of the illustrative embodiment according to one or more aspects of the disclosure.

FIG. 15 depicts a flowchart according to the fourth variation. When the control device 20 determines that the temperature T is the predetermined temperature T0 or higher (e.g., YES in step S31), the control device 20 may select the normal print mode (e.g., step S32). When the control device 20 determines that the temperature T is lower than the predetermined temperature T0 (e.g., NO in step S31), the control device 20 may select the low-temperature print mode (e.g., step S33). In step S33, ink may be ejected toward the same position in one dot formation area A0 from selected nozzles of the plurality of nozzles 26.

Fifth Example Variation

In this example embodiment, it is presumed that the quantity of nozzles 26 with ejection problems increases with decrease of the ink temperature under the low-temperature condition. Therefore, in this example embodiment a way to avoid a situation in which no dot is formed in a one dot formation area A0 is disclosed. In such an embodiment, the number of nozzles 26 that may be used to eject ink toward one dot formation area A0 is increased as the temperature sensed by the temperature sensor 36 decreases.

Figure 16:
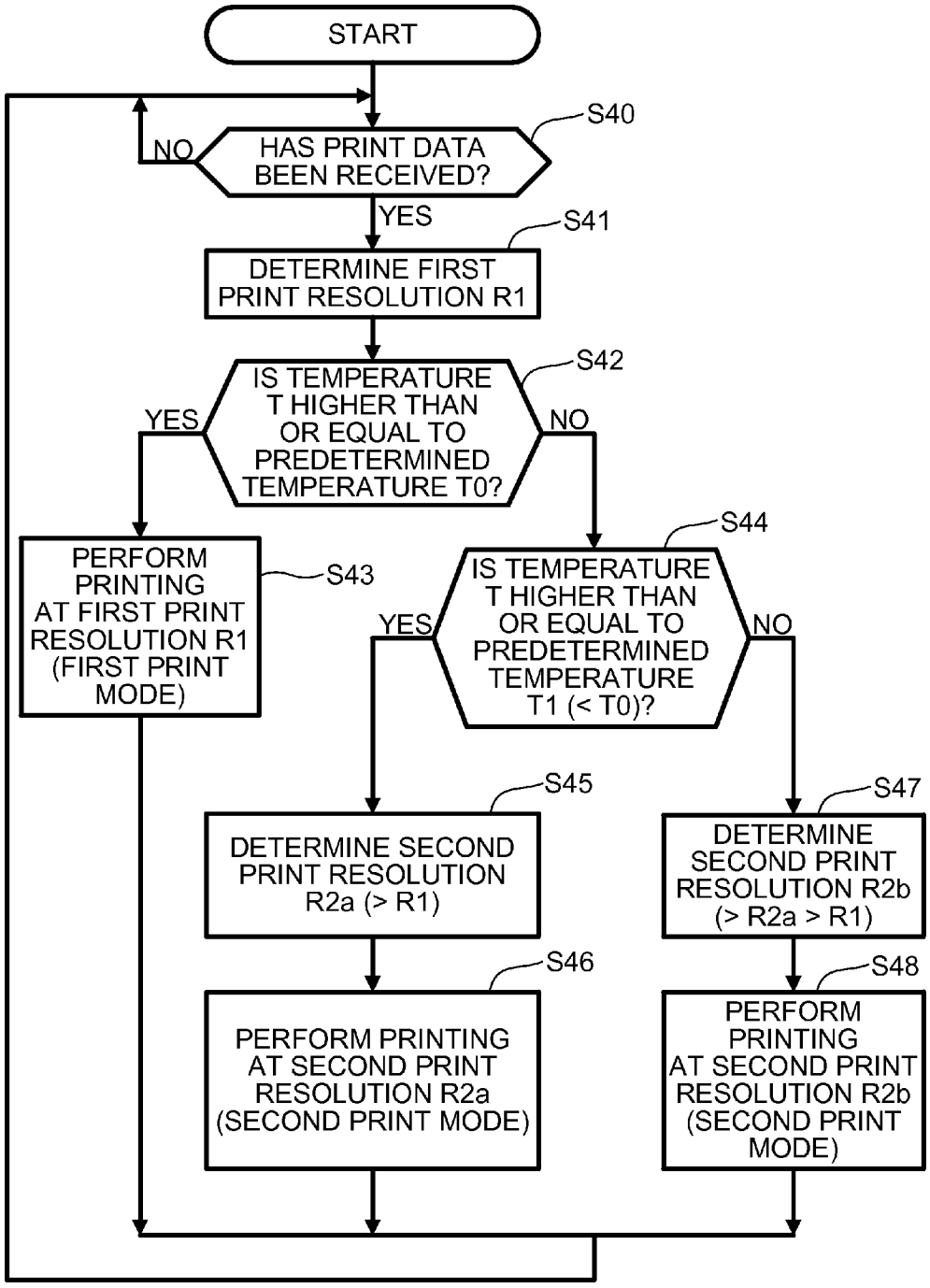
FIG. 16 is a flowchart depicting an example print data printing process in a fifth variation of the illustrative embodiment according to one or more aspects of the disclosure.

FIG. 16 depicts an example embodiment according to the fifth variation. A description of steps in FIG. 16 that are similar to the steps in FIG. 7 is omitted.

When the control device 20 determines that the temperature T sensed by the temperature sensor 36 is lower than the predetermined temperature T0 (e.g., 5° C.) (e.g., NO in step S42), the control device 20 may compare the temperature T with a predetermined temperature T1 (e.g., 3° C.) that may be lower than the predetermined temperature T0 (e.g., step S44). When the control device 20 determines that the temperature T is lower than the predetermined temperature T1 (e.g., NO in step S44), the control device 20 may designate, as a second print resolution R2*b*, a value that may be higher than a value of a print resolution designated as the second print resolution R2*a* when the temperature T is the predetermined temperature T1 or higher (e.g., YES in step S44) (e.g., steps S45 and S47).

FIG. 16 depicts an example situation in which ink is ejected toward a plurality of positions in one dot formation area A0 from selected nozzles of the plurality of nozzles 26, respectively. In this embodiment, the number of dots P2 formed in one dot formation area A0 may increase as the temperature decreases. Accordingly, this increase in selected nozzles may be referred to as an increase in print resolution. The aspects of the disclosure in which the number of nozzles to be used to eject ink toward one dot formation area A0 may be increased with a corresponding decrease in temperature may also be applied to the embodiment according to the fourth variation in which ink may be ejected toward the same position in one dot formation area A0 from selected nozzles of the plurality of nozzles 26.

In the low-temperature print mode, ink may be ejected toward one dot formation area A0 from selected nozzles of the plurality of nozzles 26. As a result, the printing speed in the low-temperature print mode may be slower than the printing speed in the normal print mode. Thus, when it is unlikely that a serious problem will occur, or when there is a reduced possibility of an occurrence of missing dots, the normal print mode may be selected with a higher priority given to the printing speed even when the printer 1 is under a low-temperature condition (although some dots may be missing when printing in the normal print mode).

Sixth Example Variation

In some example embodiments, there are various characters to be printed on a recording sheet 100. In particular, numbers, for example, may often represent important information such as a house number (or street number), telephone number, age, model number, or price. Alphabets may also represent important information as well as numbers. Therefore, when a particular-type character, for example, a number, is printed under the low-temperature condition, the control device 20 may allow the printer unit 4 to perform printing in the low-temperature print mode. However, other characters that are not designated as important may be printed in the normal print mode, due to their lower relative importance. Accordingly, in this example variation, when the printer 1 is under a low-temperature condition, the printer may remain in the normal print mode, and therefore operate at a relatively higher speed than the first embodiment described herein when only such "unimportant" characters are present.

Figure 17:
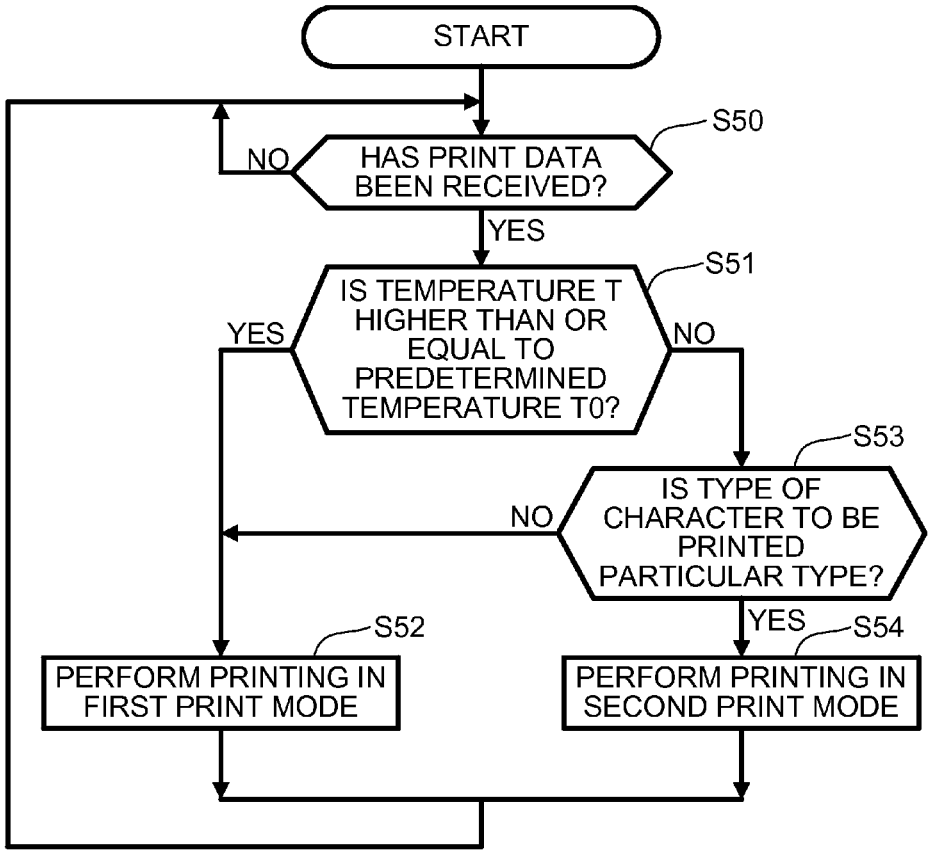
FIG. 17 is a flowchart depicting an example print data printing process in a sixth variation of the illustrative embodiment according to one or more aspects of the disclosure.

That is, as depicted in FIG. 17, when the control device 20 determines that the temperature T sensed by the temperature sensor 36 is lower than the predetermined temperature T0 (e.g., NO in step S51), the control device 20 may perform a character type analysis process for identifying a type of a character to be printed based on the received print data (e.g., step S53). More specifically, the ROM 51 of the control device 20 may store a program for analyzing print data and identifying a type of a character included in the print data. The ROM 51 may also store particular character types to be potentially identified during the character type analysis process. The control device 20 may execute the program to perform the character type analysis process. When the control device 20 determines that the type of a character to be printed is not a particular type (e.g., NO in step S53), the control device 20 may allow the printer unit 4, comprising the inkjet head 16, to perform printing in the normal print mode (e.g., step S52). When the control device 20 determines that the type of a character to be printed is a particular type (e.g., YES in step S53), the control device 20 may allow the printer unit 4 to perform printing in the low-temperature print mode (e.g., step S54).

Seventh Example Variation

In some embodiments, when the size of a character to be printed is relatively small, the character may become unidentifiable with only one missing dot. Therefore, in this example embodiment, when the size of the character to be printed is smaller than a predetermined size under the low-temperature condition, the control device 20 instructs the printer unit 4 to perform printing in the low-temperature print mode. In such an embodiment, the predetermined size may be stored in ROM 51 of the control device 20.

Figure 18:
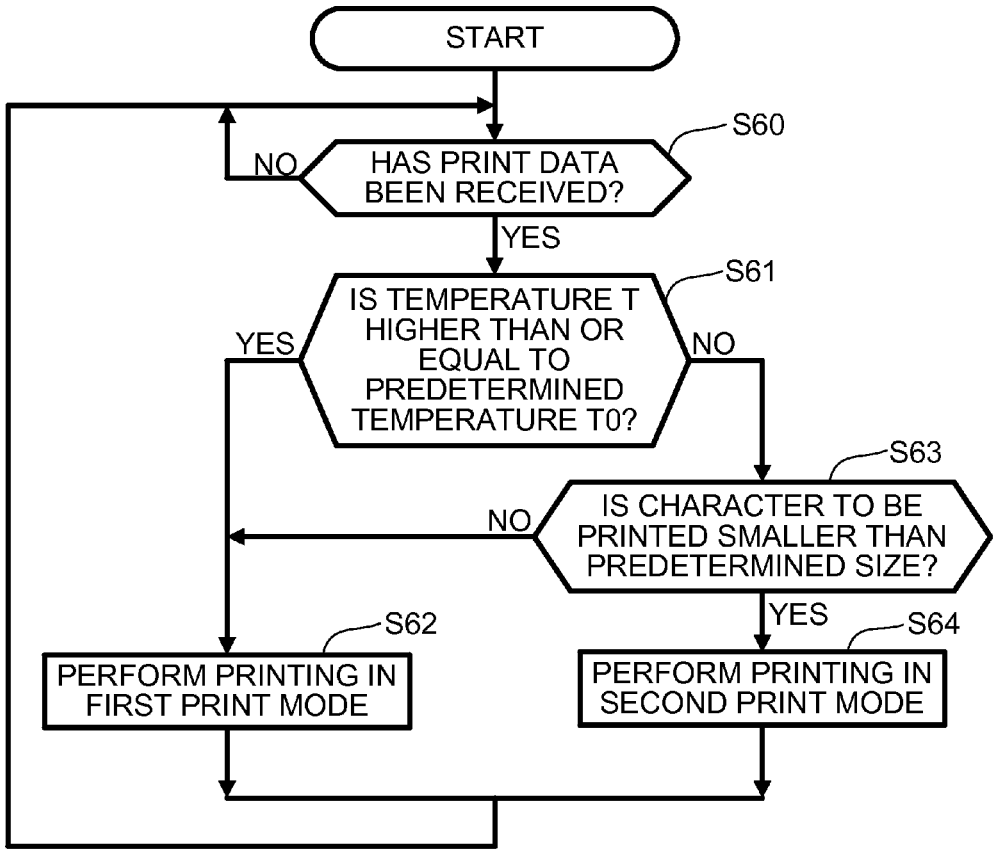
FIG. 18 is a flowchart depicting an example print data printing process in a seventh variation of the illustrative embodiment according to one or more aspects of the disclosure.

That is, as depicted in FIG. 18, when the control device 20 determines that the temperature T sensed by the temperature sensor 36 is lower than the predetermined temperature T0 (e.g., NO in step S61), the control device 20 may perform a character size analysis process for analyzing the size of the character to be printed based on the received print data (e.g., step S63). More specifically, the ROM 51 of the control device 20 may store a program for analyzing print data and identifying the size of a character included in the print data. The control device 20 may execute the program to perform the character size analysis process. When the control device 20 determines that the size of the character to be printed is the predetermined size (e.g., 10 pt) or larger (e.g., NO in step S63), the control device 20 may allow the printer unit 4 to perform printing in the normal print mode (e.g., step S62). When the control device 20 determines that the size of the character to be printed is smaller than the predetermined size (e.g., YES in step S63), the control device 20 may allow the printer unit 4 to perform printing in the low-temperature print mode (e.g., step S64).

Eighth Example Variation

In some embodiments, when the quantity of dots constituting a character is low, there is a case where the character becomes unidentifiable with only one missing dot, similar to the seventh variation. Therefore, in this embodiment, when the number of dots of the character to be printed is less than a predetermined value under the low-temperature condition, the control device 20 allows the printer unit 4 to perform printing in the low-temperature print mode.

Figure 19:
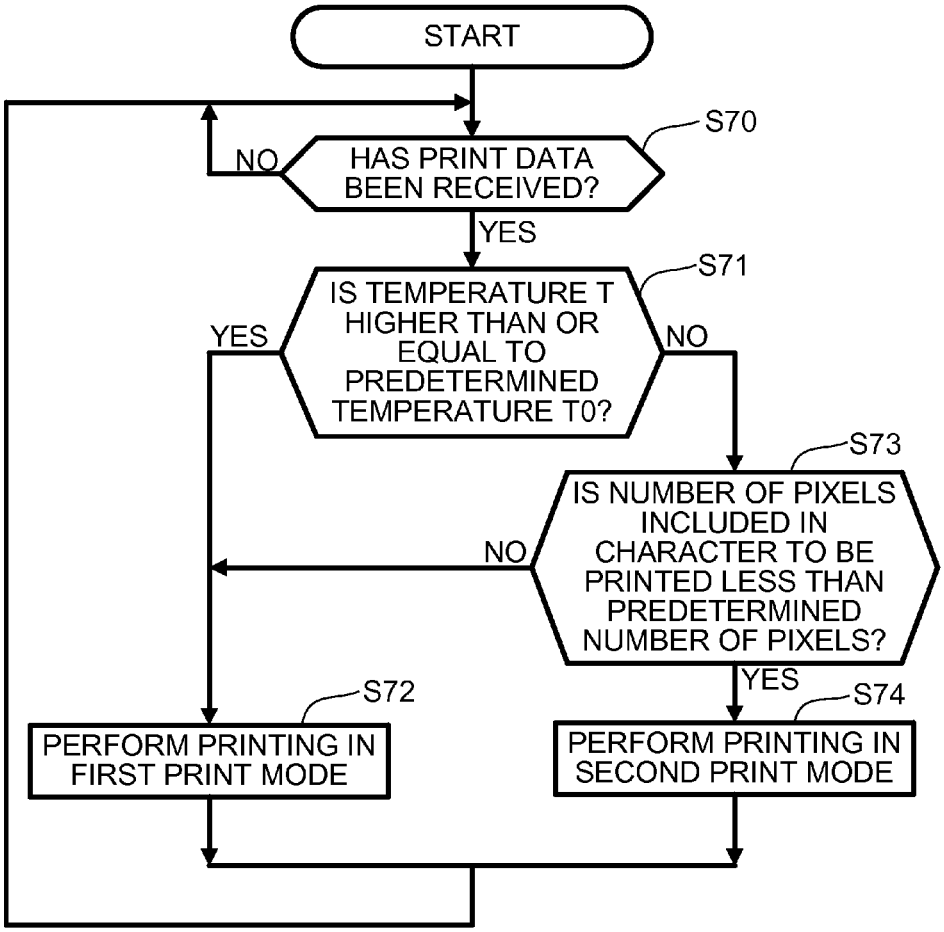
FIG. 19 is a flowchart depicting an example print data printing process in an eighth variation of the illustrative embodiment according to one or more aspects of the disclosure.

That is, as depicted in FIG. 19, when the control device 20 determines that the temperature T sensed by the temperature sensor 36 is lower than the predetermined temperature T0 (e.g., NO in step S71), the control device 20 may perform a character-constituting dot count analysis process for analyzing the number of dots of the character to be printed based on the received print data (e.g., step S73). More specifically, the ROM 51 of the control device 20 may store a program for analyzing print data and determining the number of dots constituting each character included in the print data. The control device 20 may execute the program to perform the character-constituting dot count analysis process. When the control device 20 determines that the number of dots of the character to be printed is a predetermined number (e.g., 20 dots) or higher (e.g., NO in step S73), the control device 20 may allow the printer unit 4 to perform printing in the normal print mode (e.g., step S72). When the control device 20 determines that the number of dots of the character to be printed is less than the predetermined number (e.g., YES in step S73), the control device 20 may allow the printer unit 4 to perform printing in the low-temperature print mode (e.g., step S74). As described in the illustrative embodiment, when the different print resolutions are used in the normal print mode and the low-temperature print mode, respectively, the number of dots constituting one character may also differ between the normal print mode and the low-temperature print mode. In this case, the dot count may be determined in step S63 based on either the dot count in the normal print mode or the dot count in the low-temperature print mode.

In each of the sixth to eighth variations, it may be possible that the character type analysis process (e.g., step S53 in FIG. 17), the character size analysis process (e.g., step S63 in FIG. 18), and the character-constituting dot count analysis process (e.g., step S73 in FIG. 19) are performed on each character included in print data, and the print mode is selected for each character based on the results of the above processes. It may mean, however, that the drive frequency of the driver IC 47 and the moving speed of the carriage 15 need to be changed for each character. In reality, the control may become extremely complicated. Thus, the change of the analysis process and the print mode may be preferably performed by a group of print data. For example, the above analysis processes may be performed by one recording sheet 100 of print data and the print mode may be changed for every printing on a recording sheet 100. In another case, the analysis processes may be performed for every scan(pass) by the carriage 15.

Further, two or three of the analysis processes according to the sixth, seventh, and eight variations may be performed in combination. For example, the analysis processes may be performed appropriately in step S53 of FIG. 17 and in step S73 of FIG. 19. When there is a character as to which a positive determination is made in one of the analysis processes, printing may be performed in the low-temperature print mode.

Ninth Example Variation

In this example embodiment, when a plurality types of ink may be available for use in printing, and the possibility of an occurrence of ejection failure under the low ink temperature differs among the plurality types of ink, the low-temperature print mode is be selected only when using ink that tends to cause ejection failure.

For example, in the illustrative embodiment, it may be assumed that the black ink is pigment ink and the other three ink of yellow, cyan, and magenta (referred to as "color ink") are dye ink. Generally, pigment ink contains more solvent than dye ink. Therefore, when the ink temperature is low, pigment ink may be difficult to be ejected from the nozzles 26 because pigment ink becomes more viscous than dye ink as temperature decreases.

When black pigment ink is ejected from the nozzles 26K for black ink under the low-temperature condition in the printer 1, the control device 20 may select the low-temperature print mode and allow the printer unit 4 to perform printing in the low-temperature print mode. By doing so, the dot missing in the dot formation area A0 may be prevented or the likelihood of the occurrence of a missing dot may be reduced. When color dye ink is ejected from the nozzles 26Y, 26C, 26M for color ink under the low-temperature condition in the printer 1 (i.e., when black ink is not ejected), the control device 20 may select the normal print mode and allow the printer unit 4 to perform printing in the normal print mode. As described above, when dye ink, which may cause less ejection failure during low temperatures is used, the control device 20 may select the normal print mode, giving higher priority to the printing speed.

In the ninth variation, black ink as pigment ink may correspond to first ink and color ink as dye ink may correspond to second ink. The nozzle 26K that may eject black ink may correspond to a first nozzle, and the nozzle 26Y, 26C, 26M that may eject color ink may correspond to a second nozzle.

The aspects of the ninth variation may also be applied to a case where there are nozzles having orifice diameters of different sizes. The nozzle having a smaller orifice diameter may be easier to suffer from a problem in ejection than the nozzle having a larger orifice diameter under the low-temperature condition. In this case, the low-temperature print mode may be selected when the nozzle having the smaller orifice diameter is used to eject ink therefrom, and the normal print mode may be selected when the nozzle having the larger orifice diameter is used to eject ink therefrom.

Tenth Example Variation

In this example embodiment, the temperature sensor 36 used to sense temperature is configured only to sense a temperature related to an ink temperature. The temperature sensor 36 might not be limited to a temperature sensor that may sense the environmental temperature inside the printer housing 2, as described in the illustrative embodiment. In other embodiments, for example, the temperature sensor 36 may be disposed in an ink channel in the inkjet head 16 and may be configured to measure an ink temperature directly. In another embodiment, the temperature sensor 36 may be disposed on another component disposed inside the printer housing 2, instead of the inkjet head 16 and the carriage 15 to detect the environmental temperature.

Eleventh Example Variation

In this example embodiment, the inkjet head 16 is a serial-type inkjet head 16 that is be disposed on the carriage 15 and ejects ink toward a recording sheet 100 while moving in the scanning direction. Further, the aspects of the disclosure may be also applied to a line-type inkjet head 16 that may be fixedly disposed on the printer housing 2 and have the plurality of nozzles 26 arranged in a width direction of the recording sheet 100, orthogonal to the conveyance direction.

In contrast to a serial-type inkjet head 16, a line-type inkjet head 16 might not move in the width direction of the recording sheet 100. Therefore, spacing between adjacent dots formed in a width direction of a recording sheet 100 may be equal to spacing between adjacent nozzles 26 at all times. That is, it may be impossible for the line-type inkjet head 16 to form a plurality of dots arranged in one dot formation area A0 in the width direction of the recording sheet 100 by ejecting ink from selected nozzles of the plurality of nozzles 26 toward the one dot formation area A0 of the recording sheet 100. Nevertheless, it may be possible for the line-type inkjet head 16 to form a plurality of dots arranged in the conveyance direction of the recording sheet 100 in one dot formation area A0 by controlling a conveyance amount of the recording sheet 100.

Twelfth Example Variation

In this example embodiment, the aspects of the disclosure are applied to printing that is performed based on print data transmitted through facsimile communication. There may be a reason for also applying the aspects of the disclosure sufficiently to a case where printing is performed based on print data transmitted from an external device such as a PC or a server via the Internet or a local area network ("LAN") because it is conceivable that printing needs to be performed urgently under the low-temperature condition. The source of print data is not limited to the disclosed external devices, for example, a facsimile machine, a personal computer ("PC"), or a server. For example, the aspects of the disclosure may be applied to a case where print data, for example, a character and/or an image, acquired by the scanner unit 13 (see FIGS. 1 and 2) of the inkjet printer 1 or print data acquired from a media card inserted into one or both of the slots 2*b* and 2*c* (see FIGS. 1 and 2) may be printed by the printer unit 4.

Thirteenth Example Variation

Figure 20:
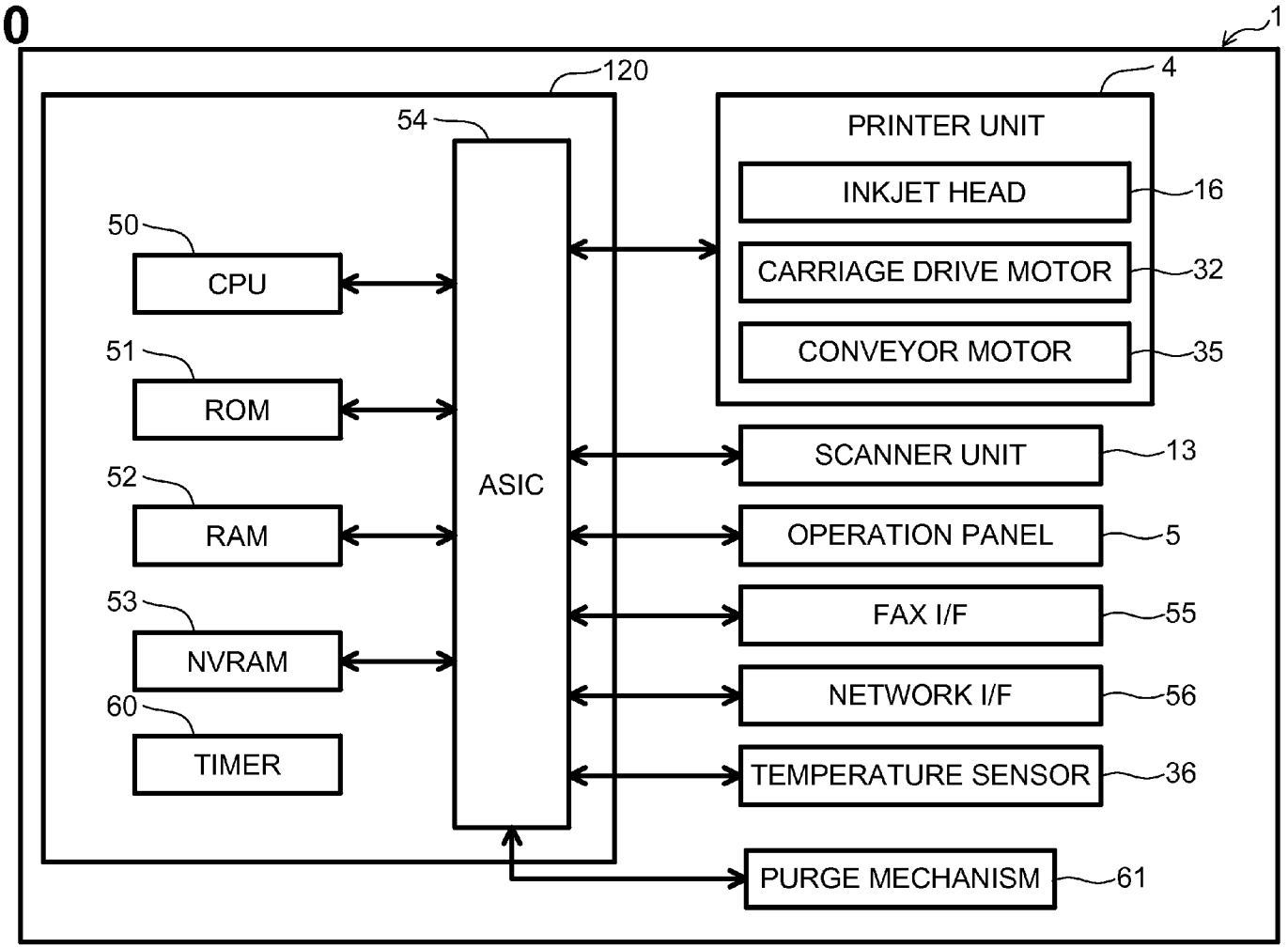
FIG. 20 is a block diagram depicting an electrical configuration of an inkjet printer in a thirteenth variation of the illustrative embodiment according to one or more aspects of the disclosure.

In this example embodiment, the execution or non-execution of a purge process for purging ink from the nozzles 26 before printing is performed is specified as well as the selection of one of the first and low-temperature print modes. As depicted in FIG. 20, a purge mechanism 61 is connected to the control device 120. The purge mechanism 61 may be configured to perform the purge process to discharge ink from the nozzles 26 of the inkjet head 16. A timer 60 may measure time elapsed from completion of a last purge process performed by the purge mechanism 61.

When the elapsed time reaches or exceeds a predetermined time, the timer 60 may output a signal related to a purge-process execution instruction to one of the CPU 50 and the ASIC 54, and thus, the control device 120 may determine that a purge-process execution instruction has been inputted. In another case, when the user performs an operation related to a provision of the purge process execution instruction on the operation panel 5, the operation panel 5 may output the signal related to the purge-process execution instruction to one of the CPU 50 and the ASIC 54. Upon input of the signal related to the purge-process execution instruction to either the CPU 50 or the ASIC 54, the control device 120 may determine that a purge-process execution instruction has been inputted.

Figure 21:
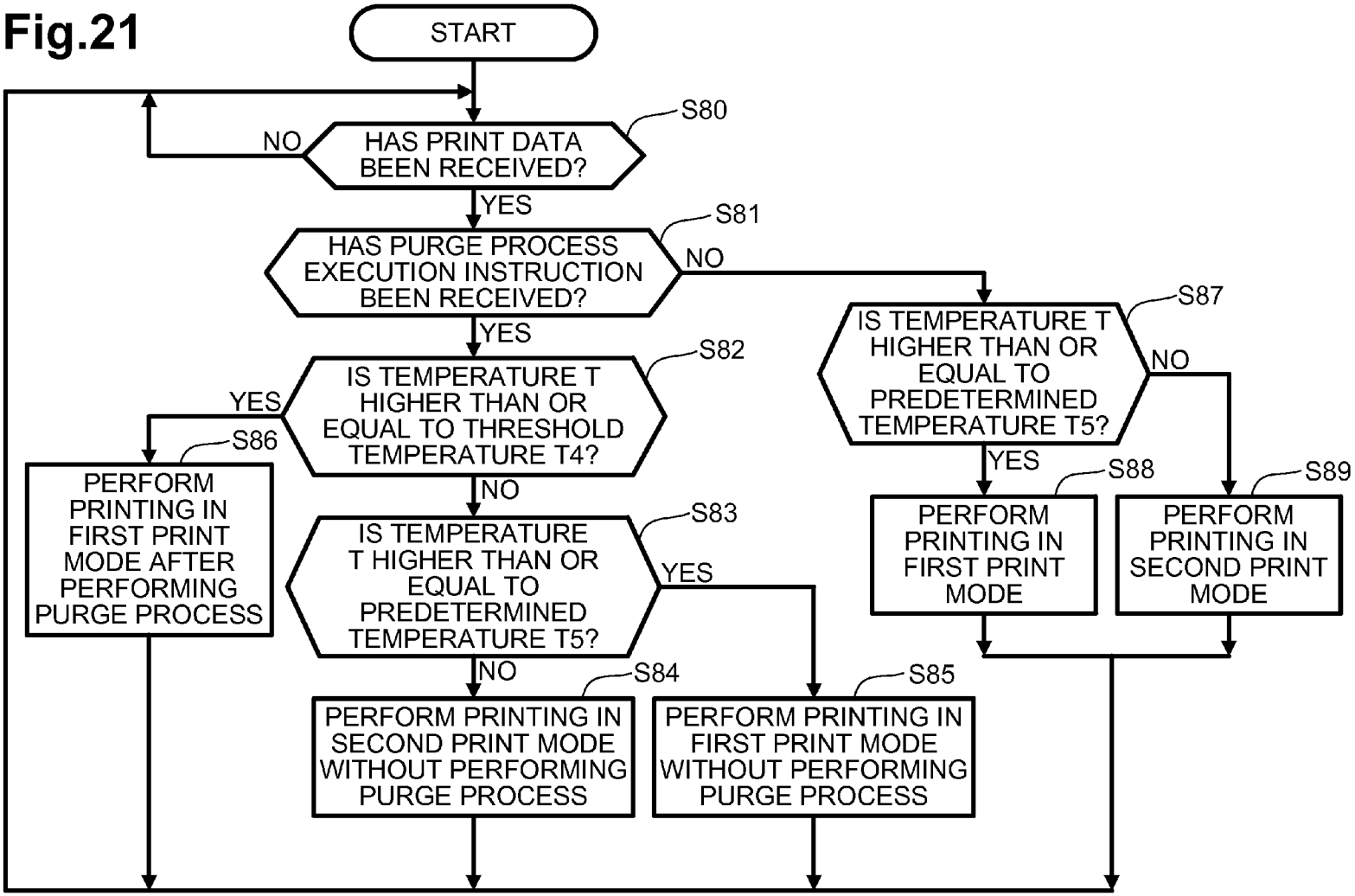
FIG. 21 is a flowchart depicting an example print data printing process in the thirteenth variation of the illustrative embodiment according to one or more aspects of the disclosure.

As depicted in FIG. 21, when print data is received via facsimile communication (e.g., YES in step S80), the control device 120 may determine whether a purge-process execution instruction has been inputted (e.g., step S81). When the control device 120 determines that a purge-process execution instruction has been inputted (e.g., YES in step S81), the control device 120 may determine whether the temperature T sensed by the temperature sensor 36 is a threshold temperature T4 or higher (e.g., step S82). The threshold temperature T4 may be higher than a predetermined temperature T5. When the control device 120 determines that the temperature T is lower than the threshold temperature T4 (e.g., NO in step S82), the control device 120 may determine whether the temperature T is the predetermined temperature T5 or higher (e.g., step S83). Then, the control device 120 determines that the temperature T is lower than the predetermined temperature T5 (e.g., NO in step S83), the control device 120 may allow the printer unit 4, comprising the inkjet head 16, to print on a recording sheet 100 at the second print resolution R2 without performing the purge process using the purge mechanism 61 before printing is performed (e.g., low-temperature print mode in step S84).

When the control device 120 determines that the temperature T is the predetermined temperature T5 or higher (e.g., YES in step S83), the control device 120 may allow the printer unit 4 to print on a recording sheet 100 at the first print resolution R1 without performing the purge process using the purge mechanism 61 before printing is performed (e.g., normal print mode in step S85).

When the control device 120 determines that the temperature T is the threshold temperature T4 or higher (e.g., YES in step S82), the control device 120 may allow the purge mechanism 61 to perform the purge process before printing is performed, and then allow the printer unit 4 to print on a recording sheet 100 at the first print resolution R1 (e.g., normal print mode in step S86).

When the control device 120 determines that the purge-process execution instruction has not been inputted (e.g., NO in step S81), the control device 120 may determine whether the temperature T is the predetermined temperature T5 or higher (e.g., step S87). When the control device 120 determines that the temperature T is the predetermined temperature T5 or higher (e.g., YES in step S87), the control device 120 may allow the printer unit 4 comprising the inkjet head 16 to perform printing on a recording sheet 100 at the first print resolution R1 (e.g., normal print mode in step S88). When the control device 120 determines that the temperature T is lower than the predetermined temperature T5 (e.g., NO in step S87), the control device 120 may allow the printer unit 4 to print on a recording sheet 100 at the first print resolution R1 (e.g., low-temperature print mode in step S89).

When ink is present in each route from the cartridge 10 to the respective nozzle 26 for a while under a condition where the temperature T sensed by the temperature sensor 36 is lower than a threshold temperature and greater than or equal to the predetermined temperature T5 (e.g., the threshold temperature T4 is −3° C., the predetermined temperature T5 is −3° C., and the detected temperature T is lower than −3° C. and higher than or equal to −5° C.), the ink may remain in a liquid state without transforming into a solid state. That is, the ink is in a super cooled state. There may be a case where the super cooled ink may crystallize suddenly at the time of the purge process. For example, when the ink inlets 27 comprise filters, respectively, the crystallized ink might not pass through the ink inlets 27, resulting in a failure to supply the ink to the nozzles 26. Nevertheless, the super cooled ink might not crystallize at the time of printing in which ink may run faster than at the time of purge process. In a case where the purge process is performed before printing, there may be a risk of ink crystallization at the time of the purge process. Therefore, it may be necessary to prevent or reduce the occurrence of missing dots by performing printing in the low-temperature print mode. Ink might not crystallize unless the purge process is performed before printing. Thus, there may be a case where printing is not performed in the low-temperature print mode. Accordingly, even when a purge-process execution instruction is input before printing, the control device 120 may select an option of performing printing in the normal print mode with assigning priority to the printing speed without performing the purge process before printing on purpose if ink is in the super cooled state.

Fourteenth Example Variation

In this example embodiment, the aspects of the disclosure are applied to an inkjet printer that is dedicated to monochrome printing and includes a plurality of nozzles comprising a group of nozzles for ejecting black pigment ink and another group of nozzles for ejecting black dye ink.

Fifteenth Example Variation

In this example embodiment, the aspects of the disclosure are not limited to the inkjet printer that prints on a recording medium by ejecting ink, but also applies to a liquid ejection device that ejects liquid other than ink. For example, the aspects of the disclosure may be applied to a printing device that may form a conductor pattern on a substrate (as another example of the medium) by ejecting conductive liquid. That is, under the normal condition, liquid may be ejected from one nozzle toward a predetermined area of the medium, such as the substrate (e.g., the first ejection mode). Under the low-temperature condition, liquid may be ejected toward the predetermined area from a plurality of nozzles, respectively (e.g., the second ejection mode). Therefore, even when one or more nozzles may suffer from a problem in ejection due to low temperature, liquid may be ejected from the rest of the nozzles and thus the ejected liquid may land on the predetermined area. In the example of the printing device, the above configuration may prevent or reduce an occurrence of conductive failure in a portion of the conductor pattern that may be caused by ejection failure in the one or more nozzles due to the low-temperature condition.

Referring now to FIGS. 1-21 generally, it is noted that the embodiments and variations described herein represent only some of the possible configurations contemplated by the present disclosure. It is noted that the various functional alternatives can be performed using any of a variety of different structural arrangements of nozzles, nozzle groups, or other features of a printing device; similarly, each of the different structural arrangements could implement any of the functional alternatives discussed herein, or other alternatives as would be known by one of skill in the art. Accordingly, the invention as contemplated in the present application is not limited to the embodiments discussed herein, but rather is as reflected in the following claims.

What is claimed is:

1. An inkjet printer configured to perform printing on a medium by ejecting ink based on print data, comprising:

an inkjet head comprising a plurality of nozzles, the plurality of nozzles are divided into a plurality of nozzle groups, each nozzle of a nozzle group configured to eject ink of a same color;

a temperature sensor configured to sense a temperature; and a control device configured to:

acquire a temperature value based on the temperature sensed by the temperature sensor;

control the inkjet head to print in a normal print mode, wherein the inkjet head ejects one ink droplet toward a dot formation area on the medium based on the print data from one nozzle included in a selected nozzle group included in the plurality of nozzle groups, the one ink droplet is ejected toward the dot formation area on the medium to form one dot on the dot formation area, the normal print mode used under a condition in which the temperature value is greater than or equal to a predetermined value; and control the inkjet head to print in a low-temperature print mode, wherein the inkjet head ejects a plurality of ink droplets toward the dot formation area on the medium from at least two nozzles included in the selected nozzle group, the plurality of ink droplets are ejected toward the dot formation area on the medium to form at least one dot on the dot formation area, the low-temperature print mode used under a condition in which the temperature value is smaller than the predetermined value.

2. The inkjet printer according to claim 1, wherein each nozzle group of the plurality of nozzle groups including nozzles configured to eject ink of a color different from ink ejected from any nozzles of a different nozzle group of the plurality of nozzle groups.

3. The inkjet printer according to claim 1, wherein the at least two nozzles includes the one nozzle.

4. The inkjet printer according to claim 1, wherein the control device is further configured to:

control the inkjet head to print at a first print resolution, the first print resolution used in the normal print mode; and control the inkjet head to print at a second print resolution, the second print resolution used in the low-temperature print mode, wherein each of the at least two nozzles is configured to eject ink toward one of a plurality of positions in the dot formation area;

wherein the second print resolution is higher than the first print resolution.

5. The inkjet printer according to claim 4, wherein the control device is further configured to:

store ejection information indicating a relationship between each of a plurality of print resolutions and an amount of ink ejected from each of the plurality of nozzles;

select one of the plurality of print resolutions as the first print resolution;

determine, from the ejection information, the amount of ink ejected from each of the plurality of nozzles in the normal print mode;

select one of the plurality of print resolutions as the second print resolution; and determine, from the ejection information, the amount of ink ejected from each of the plurality of nozzles in the low-temperature print mode, based on the second resolution and the ejection amount information;

wherein the amount of ink ejected in the low-temperature print mode is larger than the amount of ink ejected in the normal print mode at the second print resolution.

6. The inkjet printer according to claim 5, wherein the control device is further configured to store the plurality of print resolutions and an amount of ink ejected from each of the plurality of nozzles.

7. The inkjet printer according to claim 1, wherein the control device is further configured to:

perform a character type analysis process for analyzing a type of a character to be printed on the medium based on the print data under the low temperature condition;

control the inkjet head to print in the low-temperature print mode when the type of the character analyzed by the character type analysis process is a particular type; and control the inkjet head to print in the normal print mode when the type of the character analyzed by the character type analysis process is not the particular type.

8. The inkjet printer according to claim 1, wherein the control device is further configured to:

perform a character size analysis process for analyzing a character size of at least one character printed on the medium based on the print data;

control the inkjet head to print in the low-temperature print mode when the character size analyzed in the character size analysis process is smaller than a predetermined size; and control the inkjet head to print in the normal print mode when the character size analyzed in the character size analysis process is greater than or equal to the predetermined size.

9. The inkjet printer according to claim 1, wherein the control device is further configured to:

perform a character dot count analysis process for analyzing a character dot count printed on the medium, based on the print data;

control the inkjet head to print in the low-temperature print mode when the character dot count analyzed in the character dot count analysis process is smaller than a predetermined count; and control the inkjet head to print in the normal print mode when the character dot count is greater than or equal to the predetermined count.

10. The inkjet printer according to claim 1, wherein the control device is further configured to select a number of nozzles for ejecting ink from each of the one or more selected nozzle groups, wherein the number of nozzles selected increases as the temperature decreases in the low-temperature print mode.

11. The inkjet printer according to claim 1, wherein each of the one or more nozzle groups comprises a row of nozzles arranged along a predetermined direction; and wherein the control device is further configured to control the inkjet head to eject ink toward the dot formation area from at least two nozzles included in the selected nozzle group in the low-temperature print mode, wherein each nozzle of the at least two nozzles are not adjacent to one another.

12. The inkjet printer according to claim 11, wherein the at least two nozzles included in the selected nozzle group includes a first endmost nozzle and a second endmost nozzle, the first endmost nozzle positioned at a first end of the selected nozzle group in the predetermined direction and the second endmost nozzle positioned at a second end of the selected nozzle group in the predetermined direction; and wherein the control device is further configured to control the inkjet head to eject ink toward the dot formation area from at least one of the first endmost nozzle and the second endmost nozzle in the low-temperature print mode.

13. The inkjet printer according to claim 1, wherein the plurality of nozzles includes a plurality of first nozzles for ejecting first ink, and a plurality of second nozzles for ejecting second ink, wherein the control device is further configured to:

control the inkjet head to print in the low-temperature print mode such that one or more of the plurality of first nozzles and second nozzles are used to eject at least one of the first ink and the second ink; and control the inkjet head to print in the normal print mode such that none of the plurality of first nozzles are used to eject the first ink and at least one or more of the plurality of second nozzles are used to eject the second ink.

14. The inkjet printer according to claim 13, wherein an orifice diameter of each of the plurality of first nozzles is larger than an orifice diameter of each of the plurality of second nozzles.

15. The inkjet printer according to claim 4, wherein each of the plurality of ink droplets is smaller than the one ink droplet.

16. The inkjet printer according to claim 1, further comprising:

a purge mechanism configured to perform a purge process for discharging the ink from the plurality of nozzles; and a timer configured to measure time elapsed from completion of the purge process to initiation of a subsequent purge process;

wherein the control device is further configured to:

instruct, when the elapsed time reaches or exceeds a predetermined time, the purge mechanism to stop the purge process before the inkjet head prints in the low-temperature print mode under the low temperature condition, instruct, when the elapsed time reaches or exceeds the predetermined time and the temperature is greater than or equal to a predetermined threshold value that is greater than the predetermined value, the purge mechanism to perform the purge process before the inkjet head prints in the normal print mode under the normal condition, and instruct, when the elapsed time reaches or exceeds the predetermined time and the temperature is smaller than the predetermined threshold value, the purge mechanism not to perform the purge process before the inkjet head prints in the normal print mode under the normal condition.

17. A method for printing on a medium based on print data using an inkjet printer, the method comprising:

ejecting one ink droplet from one nozzle in a selected nozzle group included in a plurality of nozzle groups toward a dot formation area on the medium, under a normal condition in which the temperature is greater than or equal to a predetermined value; and ejecting a plurality of ink droplets toward the dot formation area from at least two nozzles included in the selected nozzle group to form at least one dot on the dot formation area on a medium under a low temperature condition in which the temperature is smaller than the predetermined value;

wherein each nozzle group of the plurality of nozzle groups including nozzles configured to eject ink of a same color.

18. A method for printing on a medium based on print data using an inkjet printer, the method comprising:

selecting a print mode from a normal print mode and a low-temperature print mode;

wherein in the normal print mode, the inkjet printer ejects one ink droplet from a plurality of nozzles, wherein the plurality of nozzles are divided into a plurality of nozzle groups, toward a dot formation area on the medium from one nozzle in one selected nozzle group being from the plurality of nozzle groups, under a normal condition in which the temperature is greater than or equal to a predetermined value; and wherein in the low-temperature print mode, the inkjet printer ejects a plurality of ink droplets toward the dot formation area from at least two nozzles in the one selected nozzle group to form at least one dot on the dot formation area on the medium under a low temperature condition in which the temperature is smaller than the predetermined value.

19. The inkjet printer according to claim 1, wherein, in the normal mode, the inkjet head ejects one ink droplet toward the dot formation area on the medium from one nozzle included in two or more selected nozzle groups included in the plurality of nozzle groups, the two or more selected nozzle groups ejecting ink of different colors from each other.

20. The inkjet printer according to claim 1, wherein, in the low temperature print mode, the plurality of ink droplets ejected by the inkjet head includes:

a first ink droplet ejected from a first nozzle included in the selected nozzle group toward the dot formation area while the medium is in a first position;

a second ink droplet ejected from a second nozzle included in the selected nozzle group toward the dot formation area while the medium is in a second position;

a third ink droplet ejected from a third nozzle included in the selected nozzle group toward the dot formation area while the medium is in a third position; and a fourth ink droplet ejected from a second nozzle included in the selected nozzle group toward the dot formation area while the medium is in a fourth position;

wherein the first and second nozzles are spaced apart by a first distance, the second and third nozzles are spaced apart by a second distance, and the third and fourth nozzles are spaced apart by a third distance, wherein the second distance is smaller than the first distance and the third distance is equal to the first distance.

21. The inkjet printer according to claim 1, wherein the dot formation area includes a potential area to be formed with one dot on the medium in a normal print mode.

22. The inkjet printer according to claim 21, wherein, in the low-temperature mode, the plurality of ink droplets ejected by the inkjet head are ejected toward a same position within the dot formation area.

* * * * *